US011633770B2

(12) United States Patent
Troive

(10) Patent No.: US 11,633,770 B2
(45) Date of Patent: Apr. 25, 2023

(54) BENDING METHOD

(71) Applicant: SSAB TECHNOLOGY AB, Stockholm (SE)

(72) Inventor: Lars Troive, Stockholm (SE)

(73) Assignee: SSAB TECHNOLOGY AB, Stockholm (SE)

( * ) Notice: Subject to any disclaimer, the term of this patent is extended or adjusted under 35 U.S.C. 154(b) by 273 days.

(21) Appl. No.: 15/773,041

(22) PCT Filed: Nov. 3, 2016

(86) PCT No.: PCT/EP2016/076509
§ 371 (c)(1),
(2) Date: May 2, 2018

(87) PCT Pub. No.: WO2017/076946
PCT Pub. Date: May 11, 2017

(65) Prior Publication Data

US 2018/0318898 A1 Nov. 8, 2018

(30) Foreign Application Priority Data

Nov. 3, 2015 (EP) ..... 15192746

(51) Int. Cl.
*B21D 5/02* (2006.01)
*B21D 5/01* (2006.01)

(52) U.S. Cl.
CPC ..... *B21D 5/02* (2013.01); *B21D 5/01* (2013.01)

(58) Field of Classification Search
CPC ..... B21D 5/0218; B21D 5/0227; B21D 5/00; B21D 5/0209; B21D 5/01; B21D 5/02; B21D 5/0263; B21D 5/0281
(Continued)

(56) References Cited

U.S. PATENT DOCUMENTS 2,908,315 A * 10/1959 Hellwig ..... B21D 5/0209 72/213
3,457,759 A * 7/1969 Doerr ..... B21D 11/20 72/352
(Continued)

FOREIGN PATENT DOCUMENTS

CN 1198969 A 11/1998
CN 201147785 Y 11/2008
(Continued)

OTHER PUBLICATIONS

A.C. Bannister, "Structural Integrity Assessment Procedures for European Industry", British Steel plc, pp. 4 & 20 (Year: 1995).*
(Continued)

*Primary Examiner* — Shelley M Self
*Assistant Examiner* — P Derek Pressley
(74) *Attorney, Agent, or Firm* — Ballard Spahr LLP

(57) ABSTRACT

The present disclosure provides a method for air bending a plate of material such as steel which is characterised by having two bending steps, wherein the bending punch in the second bending step has a smaller radius and/or the die width used in the second bending step is smaller than the die width used in the first bending step. The method of the disclosure can achieve a significant improvement in the bendability of materials, particularly high strength steels. The disclosure also provides new bending apparatus that are specifically adapted to carrying out the method of the disclosure, including a nested double die having a second narrower die residing below and within the first die, and an adjustable die having a height adjustment means (either in the support, bending punch or both) capable of accommodating movement of the material during the adjustment to form the second die width.

12 Claims, 20 Drawing Sheets

(58) Field of Classification Search
USPC ..... 72/389.1–389.3
See application file for complete search history.

(56) References Cited

U.S. PATENT DOCUMENTS

| | | | | | |
|---|---|---|---|---|---|
| 3,610,019 | A * | 10/1971 | Denninger | B21D 5/02 | 72/413 |
| 3,890,820 | A | 6/1975 | Hoggan et al. | | |
| 3,990,291 | A | 11/1976 | Evertz et al. | | |
| 4,367,644 | A * | 1/1983 | Kramer | B21D 5/0227 | 72/389.4 |
| 5,027,633 | A * | 7/1991 | Smith | B21D 7/06 | 72/213 |
| 5,953,951 | A | 9/1999 | Fujimoto et al. | | |
| 8,276,428 | B2 * | 10/2012 | Bruggenbrock | B21D 5/06 | 72/389.1 |
| 2009/0019908 | A1 | 1/2009 | Stangl | | |

FOREIGN PATENT DOCUMENTS

| | | | | |
|---|---|---|---|---|
| CN | 201147785 | Y | 11/2008 | |
| CN | 104056881 | A | 9/2014 | |
| CN | 204159753 | U | 2/2015 | |
| CN | 204159753 | U | 2/2015 | |
| CN | 104438494 | A | 3/2015 | |
| CN | 104438494 | A | 3/2015 | |
| CN | 204338619 | U | 5/2015 | |
| CN | 204338619 | U | 5/2015 | |
| DE | 2418668 | | 10/1975 | |
| DE | 2418668 | A1 | 10/1975 | |
| EP | 0055435 | | 7/1982 | |
| EP | 0055435 | A2 * | 7/1982 | B21D 5/01 |
| EP | 0440818 | | 8/1991 | |
| EP | 1 792 669 | | 6/2007 | |
| GB | 1489257 | | 10/1977 | |
| GB | 1489257 | A | 10/1977 | |
| JP | S57-112926 | A | 7/1982 | |
| JP | S59198624 | | 11/1984 | |
| JP | S59-198624 | | 12/1984 | |
| JP | 61067521 | A * | 4/1986 | B21D 5/01 |
| JP | S61126988 | | 6/1986 | |
| JP | S61168498 | | 7/1986 | |
| JP | 01186219 | A * | 7/1989 | |
| JP | H01-186219 | A | 7/1989 | |
| JP | H01228612 | A | 9/1989 | |
| JP | H06-246354 | A | 9/1994 | |
| JP | H0390217 | A | 3/1996 | |
| JP | 2002079320 | A | 3/2002 | |
| JP | H06246354 | A | 8/2002 | |
| JP | 2005305501 | A | 11/2005 | |
| JP | 2006-142324 | A | 6/2006 | |
| JP | 2006142324 | A | 6/2006 | |

OTHER PUBLICATIONS

Bob Butchart, Selecting a new press brake, Mar. 23, 2001, the Fabricator (Year: 2001).*
Butchart, "Selecting a New Press Brake" (Year: 2001).*
Bannister, "Structural Integrity Assessment Procedures for European Industry" (Year: 1996).*
Partial European Search Report dated May 2, 2016 by the European Patent Office for Patent Application No. 15192746.4, which was filed on Nov. 3, 2015 and published as EP 3165297 on May 10, 2017 (Inventor—Lars Troive; Applicant—Valea AB) (5 pages).
European Search Report dated Jun. 8, 2016 by the European Patent Office for Patent Application No. 15192746.4, which was filed on Nov. 3, 2015 and published as EP 3165297 on May 10, 2017 (Inventor—Lars Troive; Applicant—Valea AB) (9 pages).
Communication Pursuant to Article 94(3) EPC dated Mar. 6, 2018 by the European Patent Office for Patent Application No. 15192746.4, which was filed on Nov. 3, 2015 and published as EP 3165297 on May 10, 2017 (Inventor—Lars Troive; Applicant—Valea AB) (4 pages).
International Search Report and Written Opinion dated Mar. 31, 2017 by the International Searching Authority for Patent Application No. PCT/EP2016/076509, which was filed on Nov. 3, 2016 and published as WO 2017/076946 on May 11, 2017 Inventor—Lars Troive; Applicant—Valea AB) (13 pages).

* cited by examiner

A B C D E

BENDING METHOD

This application is a U.S. National Phase Application of International Application No. PCT/EP2016/076509, filed Nov. 3, 2016, which claims the benefit of European Patent Application No. 15192746.4, filed Nov. 3, 2015, each of which are incorporated herein by reference in their entirety.

TECHNICAL FIELD

The present disclosure relates to methods of bending plates of materials i.e. any solid material having the ability to deform under tensile stress such as a material, in particular air bending methods in which the bendability materials having low ductility can be improved.

BACKGROUND OF THE DISCLOSURE

Materials such as steel are often processed using rollers to provide sheets (or plates) of material. While these can be utilised directly as sheets/plates, often they are further processed by a variety of forming techniques such as bending and the like to form non-planar shapes.

There are several methodologies for bending materials, including air bending, folding, roll bending and roll forming.

Air bending is a three point free bending method which involves positioning a material over an opening (the die opening), and forcing a bending punch in a direction perpendicular to the material equidistant between the die edges. Air bending does not require the bottom tool to have the same radius as the punch. The punch forms the bend so that the distance between the punch and the side wall of the die opening is substantially greater than the material thickness. The bend radius is therefore determined by the material's elasto-plastic behaviour rather than the tool shape.

Folding involves clamping a material and using a bending punch to fold the material around a bending profile. The bending punch effectively urges the material against the bending profile, and as such the distance between the punch and profile are typically close to the material thickness. In contrast to air bending, the shape of the material and the bend radius are influenced by the tool geometry and material properties.

Folding processes can also be used to form U-shaped profiles or multiple bends (such as a square-shaped U) in one bending motion. Such processes typically also require a counter force applied to the face of the material opposite to the bending punch, such that the material is clamped and drawn into the die when folding.

Typically, the die and punch are of a predetermined size and geometry during bending processes. However, adjustable dies and multi-step processes are known.

For instance, EP0055435 discloses a folding process which is characterised by having two bending steps. The punch and/or die are adjusted between the first and second bending step to ensure that the bend in each step is created at a different locus. In this way, the effects of the springback that arise following bending are mitigated.

U.S. Pat. No. 5,953,951 discloses a folding process which creates a profile that has a bend along its length (i.e. a shaped material having a lengthwise axis and an axis crosswise to the lengthwise axis, wherein the material has a bend along the crosswise axis and a bend along the lengthwise axis). The bends are formed using a die member that has different portions having different bend radii.

In roll-forming, the bends are made in several steps by passing the material through a number of rollers which are located both above and below the material being bent. The use of rollers both above and below forces the material to follow the tool geometry, and tight bending radii are possible even for high strength materials. However, the methodology is comparatively expensive, especially for low production volumes.

In roll bending, the punch and die portions cooperate to move the material through the die/punch arrangement to create a bend in the material. U.S. Pat. No. 3,890,820 discloses a modified apparatus for roll bending which allows the width of the die portions to be adjusted. In one embodiment, a spring urges serrated surfaces on the die portions and the supporting against one another such that they are unable to slide.

Adjustable dies are also known from air bending, for instance as disclosed in DE2418668.

The ductility of metallic materials can vary greatly. Often, high strength metallic materials such as Advanced High Strength Steel (AHSS) are highly crystalline. While this generally provides very high yield strengths, the ductility can be severely compromised. Sheets of metallic materials are commonly characterised by their bendability (i.e. the ratio of the radius of the inner curve of a 90° bend and the sheet thickness, t), with higher strength materials generally having a minimum bend radius of several multiples of t. If metallic materials are bent at levels beyond their minimum bend radius, the outer surface of the bend tends to become deformed showing local flattening rather than a smooth curve, indicating localisations of strain in the bend and potential weaknesses in the metallic material.

The lack of bendability of higher strength metallic materials can hinder their usability in certain applications, and there is consequently an ongoing need to provide high strength metallic materials that provide improved bending performance. One way of improving bendability is to modify the material itself, to provide an improved material that gives a better balance of strength and ductility.

The present disclosure provides an alternative to this strategy and seeks to improve the bendability of materials by using an improved bending method. In particular, the problem with flattening and localisation of strain within the bends is solved by applying a new bending technique instead of modifying the material itself.

SUMMARY OF THE DISCLOSURE

The present disclosure provides a method of forming a bend in a plate of material, said method comprising:

air bending a plate of material in a first air bending step by applying a first bending force using a first bending punch and a first die having a first die width; then air bending the plate of material in a second air bending step by applying a second bending force using a second bending punch and a second die having a second die width, wherein the first and second bending force is applied at the same point of the plate and in the same direction;

characterised in that the second die width is less than the first die width, and/or the radius of the second bending punch is less than the radius of the first bending punch.

The word "point" in the expression "same point" as used throughout this disclosure, is intended to mean a narrowly localized region of the plate corresponding to the contact area between the punch and the plate.

The word "plate" in the expression "plate of material" as used throughout this disclosure, is intended to mean any component comprising a flat piece of material or any component comprising at least one flat portion of material, such as any hot- or cold-rolled metallic product. Typically, the plate has a constant thickness over the entire portion of material being bent.

Air bending is a well-known technique for bending plates of material. Briefly, air bending involves placing a plate (or sheet) of material in contact with the edge of a die (typically a V-shaped groove with rounded tops) and the tip of a punch. The punch is aligned with (i.e. parallel to) the groove of the die and equidistant from the edges of the die opening. The punch is then forced past the top of the die into the opening without coming into contact with the bottom of the die. The opening is typically deeper than the angle which is sought in the work piece. This allows for over bending, compensating for the springback of the work piece.

As noted above, the bend radius formed when air bending is determined by the material's elasto-plastic behaviour rather than the tool shape. This occurs since the distance between the punch and side wall of the die is typically substantially greater than the thickness of the material being bent, and the material does not touch the bottom of the die opening during bending.

Air bending can be described as a three point free bending method. In other words, the bend is created solely due to the force that is exerted on the material by the three contact points, namely the force applied by the bending punch and counterforce applied by the two die edges.

In practice, the die edges are usually rollers, so as to allow the material to move easily over the die edge during bending and avoid scratching or other damage.

Likewise, the bending punch is symmetrical about the central access and typically has a continuous curved surface that contacts the metal plate (i.e. the punch does not have any corners or any other discontinuities in the cross-sectional profile of the area in contact with the metal plate). The curvature of the punch is convex, i.e. it curves outwards towards the plate which is being bent. In this way, the plate wraps evenly around the punch as it moves down during bending, such that a single, symmetrical bend is formed in the metal plate during bending.

Air bending is sometimes described as "free bending" in that it does not require a counterforce applied to the opposing side of the material opposite the bending punch. The material is therefore not clamped by a bending punch and opposing counter punch. Air bending applies a constant bending force across the entire length of the material being bent. Thus, during air bending, the bending punch extends the length of the material being bent. Moreover, the die edges and bending punch are parallel (i.e. straight and equidistant apart along their entire length), and as such create a single, uniform bend along the entire length of the material being bent.

Thus, viewed in another way, the present disclosure provides a method of forming a bend in a plate of material, said method comprising:

a. providing a plate of material supported between a first pair of parallel die supports separated by a first die width;

b. bending the plate in a first bending step by providing a first bending force via a first bending punch, said first bending force acting in a plane perpendicular to the plane formed by the supporting surfaces of the first pair of parallel die supports and which intersects the plate at the centre line between the first pair of parallel die supports, said first bending punch extending at least the entire length of the plate; and c. bending the plate in a second bending step by providing a second bending force via a second bending punch, said plate being supported between a second pair of parallel die supports separated by a second die width during said second bending step, said second bending force acting in the same plane as the first bending force, said second bending punch extending at least the entire length of the plate, wherein the second bending punch applies the second bending force during the second bending step at the same point of the plate and in the same direction as the first bending force, characterised in that the second die width is less than the first die width, and/or the radius of the second bending punch is less than the radius of the first bending punch.

Preferably, if the radius of the second bending punch is less than the radius of the first bending punch, then the first and second die widths are the same.

Likewise, if the second die width is less than the first die width, then the radius of the first bending punch is preferably the same as the radius of the second bending punch.

In the methods of the disclosure, the width of the plate is the dimension that runs across the die opening (i.e. between the pair of parallel die supports), the length of the plate is the dimension that runs parallel to the die supports, while the thickness of the plate is the dimension that runs in the direction travelled by the punch during bending. Thus, by "bending punch extending at least the entire length of the plate" is meant that the bending punch is capable of exerting the force across the entire plate, such that an even bend is formed without any buckling.

By "die supports" is meant the edges of the die that are in contact with the metallic plate. Typically, these have rounded edges to allow the plate to easily roll into the die opening as the bending punch forces the centre of the plate down forming the bend. The die can preferably be a "roller die" (i.e. cylinders that rotate freely around an axis), reducing the amount of friction. The two die supports are parallel to ensure an even distance across the die opening.

Additionally, in the present disclosure the term "above" and "below" refer to the position relative to the die opening, i.e. the plane between the die supports. "Above" as used herein being above the die opening, and "below" being below the die opening. Thus, the space below the die opening is occupied by the bend of the metallic plate as it is being formed, and moreover during air bending the bending punch will move from above the die opening to below the die opening when forming the bend in the metallic plate.

The method of the disclosure is similar to standard air bending methodologies, except that it comprises two bending steps which differ due to the die width (i.e. the distance between the supporting surfaces) and/or the punch radius (i.e. the radius of the section of the bending punch in contact with the material). The applicant has found that when using this two-step bending method, the bendability can be improved by as much as 40% or more compared to standard air bending methodologies.

By "bendability" is meant the ratio of the minimum inner radius of a 90° bend and the sheet thickness, or viewed differently the number of times the sheet thickness must be multiplied to achieve the inner radius of the 90° bend at the bendability limit of the material. The bendability is often referred to as the "minimum radius for a 90° bend" (i.e. the minimum radius achievable for a 90° bend without any distortions in the bend arising), and is expressed as a multiple of t, the sheet thickness.

Without wishing to be bound by theory, it is believed that the primary factor which leads to flattening tendencies in high strength materials is the high yield to strength ratios and also the typically very low strain hardening behaviour. The combination of these properties tends to localise the strains that arise during bending within a narrow part of the material. The high yield to strength ratios will have a negative effect on the plastic deformation of the flange.

When using material with a high yield to strength ratio, performing air-bending with a normal set-up, i.e. die width 10-13 times the thickness, will get almost no plastic deformation or shape of curvature except very close to the contact point with the punch. In other words, the main part of the angular deformation of the flange will take part very locally (like a hinge), consequentially giving a low distribution of plastic strains along the flange. In such cases, there is a higher risk of localization and phenomena such as flattening of the bend. By increasing the die-width, the area of the flange where the main part of deformation takes place is enlarged leading to a more preferable strain distribution.

These effects are shown schematically in FIG. 1. The property of yield to strength ratio is connected to a conventional tensile-stress-strain data. However, the moment-diagram (i.e. the moment vs the inverse of the bend radius) provides a more accurate way of studying the behaviour of the material during bending. The real curvature of the flange can be deduced from the moment-diagram, by studying the area above the moment-curve, as shown FIG. 1*a*.

The area above the moment curve is proportional to the real shape of curvature of the flange. In FIG. 1*a*, two types of materials are compared, one material (A) with a high yield to strength ratio, and another material (B) with a low yield to strength ratio.

The punch 302 is moving in a plane of symmetry 304 to bend said materials A or B between a die 307 to bending angle $\alpha/2$ 306. The different yield to strength ratios of these materials will lead to different shapes of the flange at bending 305. The moment is a linear function 303 along the horizontal axis. The area between the M and 1/R axis 301 is proportional to the shape of the curvature of the flange. This plot can also show the minimum free bending radius 308 to prevent kinking.

FIG. 1*b* shows that by increasing the die-width, the area for localization of strain would be distributed over a larger area. Thus, the die 307 from FIG. 1*a* is replaced by an outer die 307*a* and inner die 307*b* in FIG. 1*b*. The pre-bending by the outer die 307*a* gives a larger deformation area, resulting in less risk of localisation of bending 305. The moment curve has a modified shape 309 due to the pre-bending by the outer die 307*a*, which causes the material to behave as though it has a lower yield-strength ratio when bent using the inner die 307*b*.

A draw-back of using a larger die width is that the over-bending angle will increase as compensation for the increased springback that occurs. This increases the likelihood of strain localisation appearing at the final end of the bending stroke. The present disclosure overcomes these issues by providing methods for obtaining a smooth shape of curvature of the flange after bending, even though the material still has a high yield to strength ratio. The methods of the disclosure provide two bending steps, a first bending step which forms a relatively large curvature at the bend 305, and a second bending step which forms the final bend angle. The first bending step helps to distribute the bending forces over a larger area of the material, reducing the risk of localisations of strain (and consequently deformations forming).

Thus, one possible way of carrying out the first bending step is to apply so called free-bending, i.e. making a large radius at the bend by using a large die-width (e.g. a die width typically 20-30 (e.g. 20-25) times the material thickness), typically using a bending-punch with a relatively narrow radius. The free-bending is typically applied until the material starts to follow the shape of the bending punch. The limit of bending-angle of course depends on the material thickness, with typical approximate values of about 30-80 (e.g. 70-80) degrees for a hot-rolled material with a thickness of 4-6 mm. When this smooth shape of curvature is pre-formed, the material will behave more like a material with a lower yield to strength ratio when applying the second bending load. Typically, this is done using a conventional die-setup with a die-width of approximately 10-13 times the material thickness.

An alternative way of forcing the material to a large shape of curvature is to use a large bending punch-radius during the first bending step, such as approximately two times the final bend radius (i.e. the desired radius of the final bent material after the second bending step). Again, the first bending stroke typically forms a bending angle of approximately 30-80 (e.g. 70-80) degrees. When using the larger bending punch in the first bending step, the die-width in the second stroke can simply be the same as in the first stroke, typically approximately 10-13 the material thickness, but the bending-punch is changed to a narrow one in the second bending step.

The methodology of the present disclosure allows tight bends to be formed with a lower risk of kinking, as the conditions necessary to form the tight bend are only applied on a pre-bent material. The first bending step effectively spreads the bending strains over a much greater area providing a much larger area of plastic deformation at the bend, such that the second bending step is less likely to lead to kinking or flattening at the bend.

The method of the disclosure may be implemented in a number of ways. These preferred embodiments of the disclosure are described in more detail below.

BRIEF DESCRIPTION OF THE DRAWINGS

The present disclosure will hereinafter be further explained by means of non-limiting examples with reference to the appended figures, where.

DETAILED DESCRIPTION OF PREFERRED EMBODIMENTS

The method of the present disclosure involves two air bending steps such that the bending force of both steps is applied at the same location of the plate and in the same direction. There are several ways that the method of the disclosure may be implemented, including using the same die in both bending steps with different punches, using the same punch in both bending steps and different dies, a mixture of both wherein the first die is adjusted to a narrower die width to become the second die, or wherein both the die and the bending punch are different between in the first and second air bending step.

In turn, these different embodiments mean that the method of the disclosure may be practiced by carrying out two discrete and separate bending steps (such as might happen when the first bending punch and second bending punch are different), carrying out a continuous bending step using the same bending punch (such as might happen when the bending punch forces the plate into a second die, narrower die that resides below and within the first die), or a carrying out a staggered process which involves a graduated transition between the first and second bending steps (such as might happen when the die width is adjusted after the first bending step, as described in further detail below).

Considering each of these embodiments in turn, one way of carrying out the method of the disclosure is to carry out two, separate and discrete air bending steps using the same die (i.e. the first and second die (and first and second die width) are the same). Thus, after the first bending step, the bending punch may be removed and replaced with a second bending punch of narrower radius. This second bending punch then applies the bending force in the second bending step, wherein the second die is identical to the first die.

Figure 1A:
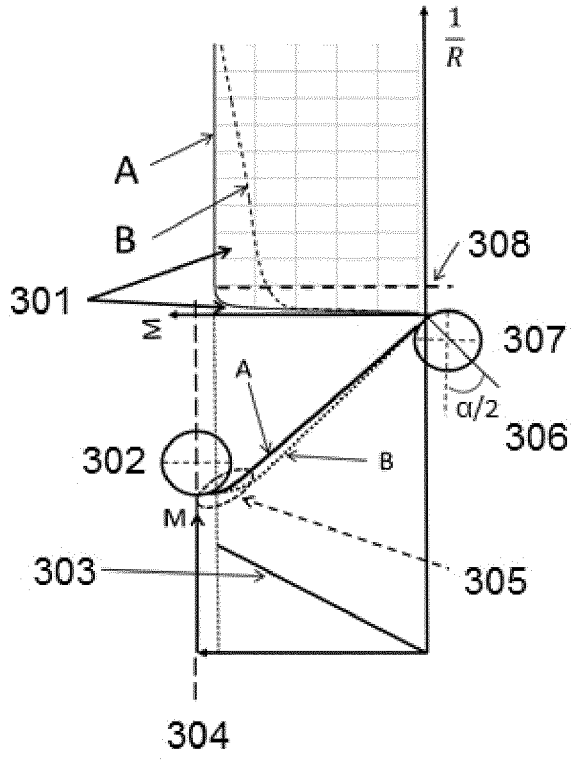
FIG. 1 shows the moment curves for a standard bending step compared to a bending step according to the disclosure.
Figure 1B:
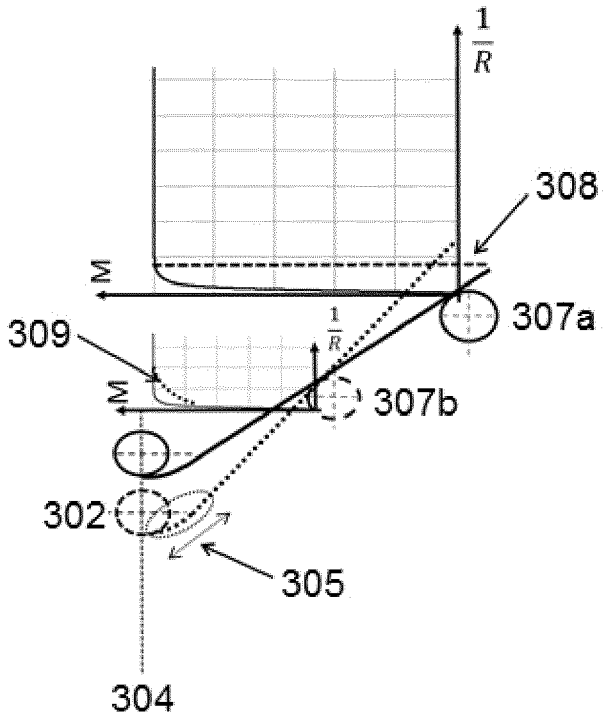
Figure 2A:
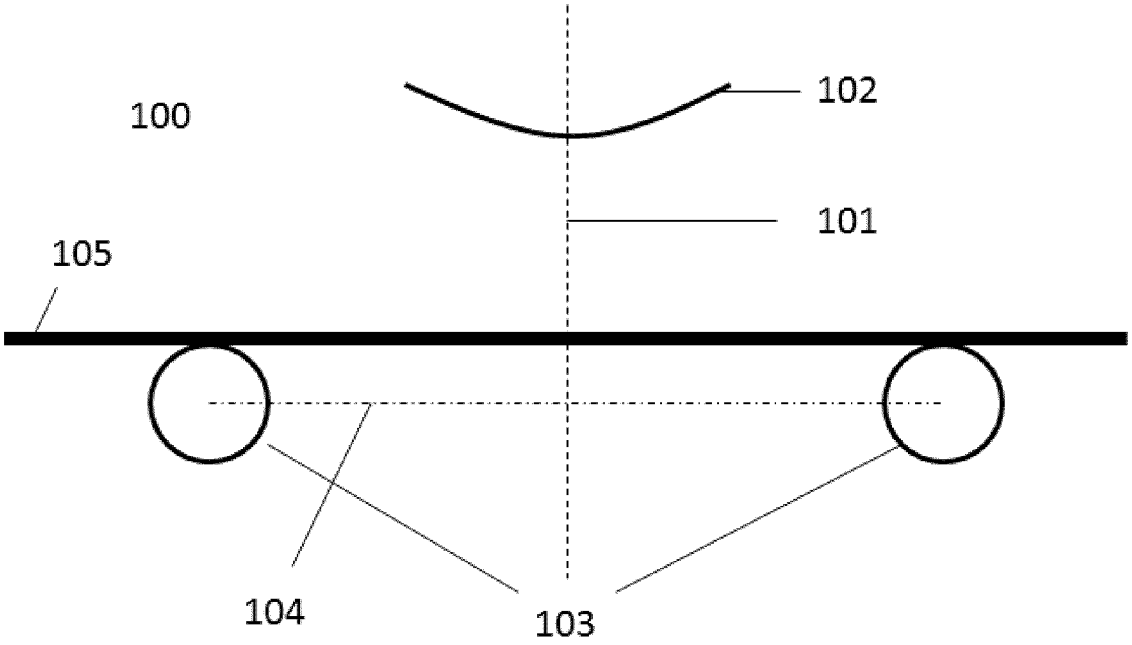
FIG. 2 shows a schematic of the first bending step in an embodiment wherein two different bending punches are used.
Figure 2B:
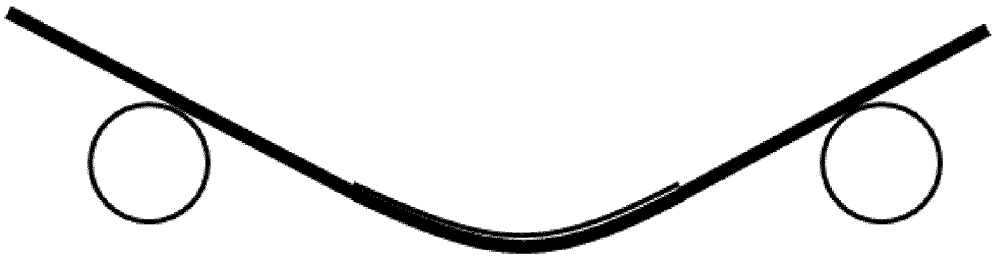
Figure 3A:
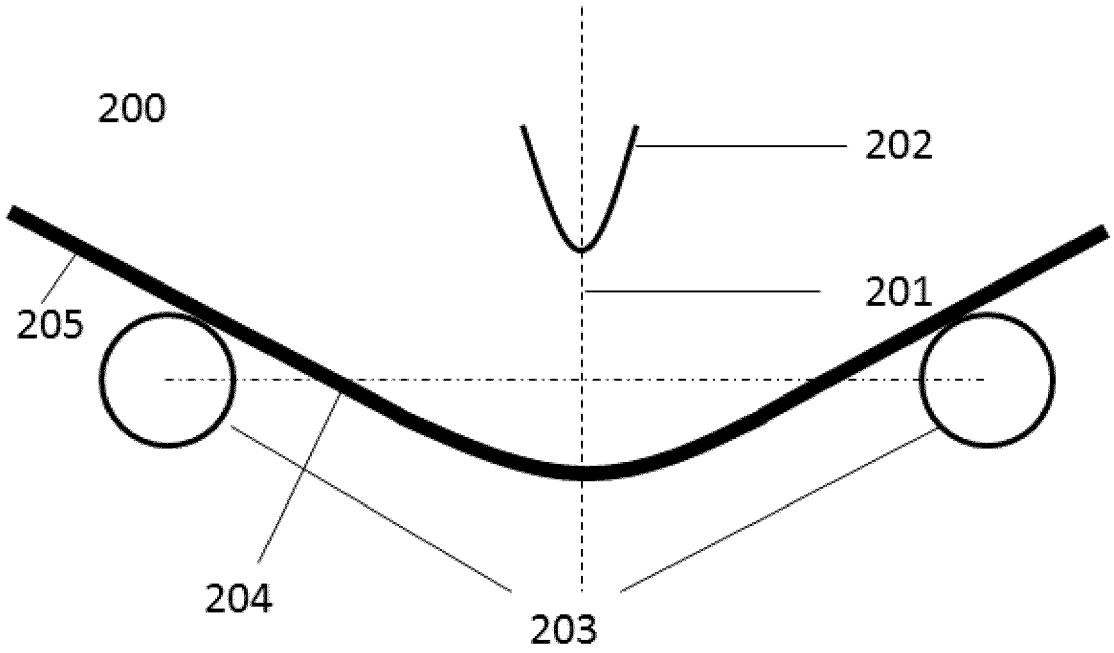
FIG. 3 shows a schematic of the second bending step in an embodiment wherein two different bending punches are used.
Figure 3B:
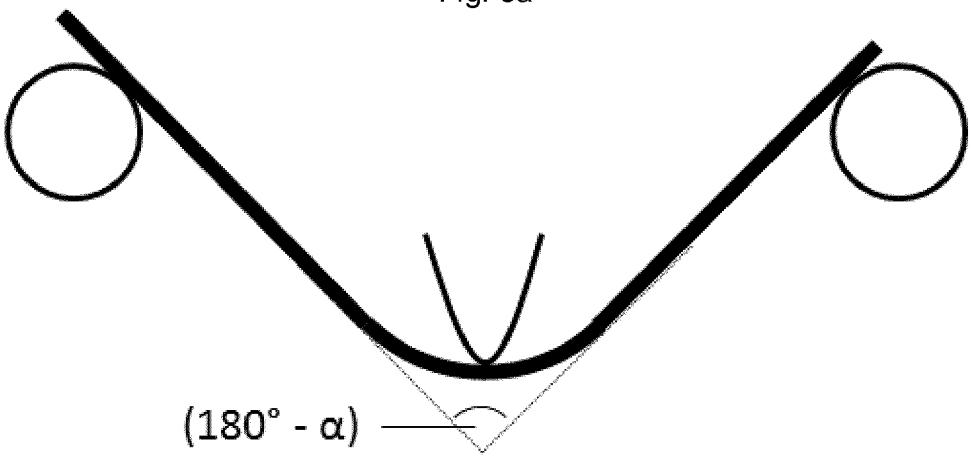

Such a method is shown in FIGS. 2-3. In FIG. 2*a*, the plate of material 105 is supported on the first die 103 having the first die width 104 in the first bending step 100. The bending force 101 is provided by a first bending punch 102 having a large radius. After the first bending step is carried out (FIG. 2*b*), the first bending punch is replaced with a second bending punch. In the second bending step 200 (FIG. 3*a*), the second bending punch 202 provides the second bending force 201 to the partially bent metallic plate 205 at the same location and in the same direction to provide the final bend (FIG. 3*b*). In this embodiment, the second die 203 and second die width 204 are identical to the first die 103 and first die width 104.

In embodiments using two bending punches, the radius of the first bending punch is larger than the radius of the second bending punch. Using a larger bending punch for the first bending step forces the material initially to get a certain shape of curvature. In this way, the bend doesn't tend to localize in the same way as when making the bend in a single stroke aiming for the same final radius.

The ratio between the first and second bending punch is not decisive, although generally speaking the larger the radius of the first bending punch, the greater the advantageous effect will be. Typically, the radius of the second bending punch is less than ¾ of the radius of the first bending punch, more desirably less than ⅔ such as about half the radius of the first bending punch.

Larger differences in ratio between the first and second bending punch can also be used, such as the second bending punch being less than ⅓ the ratio of the second bending punch, or less than ⅕ or even less than 1/10. These larger ratio differences are more typically used when the die width is quite large, or more precisely when the ratio of bending punch radius to die width is large. This is because the first punch radius cannot be too large, and should typically be <½ the die width.

Figure 16:
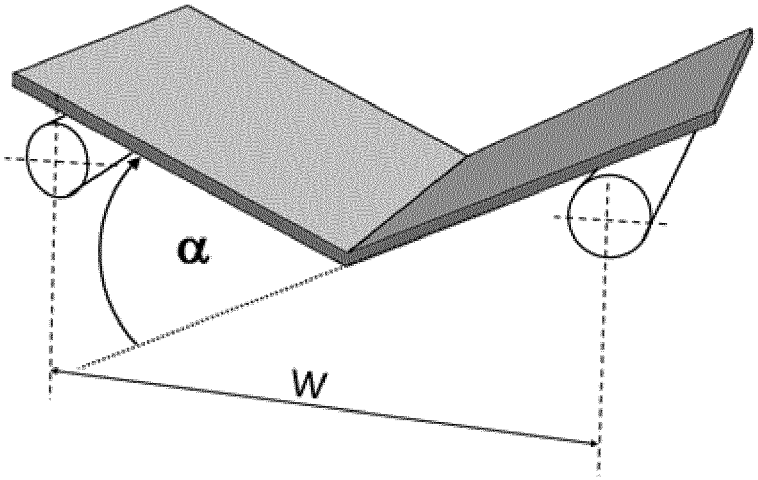
FIG. 16 shows a schematic representing the hypothetical bending angle α and the die width W.

In FIGS. 2-3 and all of the other schematic figures herein except FIG. 16, the bending apparatus is shown as a cross section across the die width. The die supports are shown as circles, though of course other shapes may be used provided they allow the plate to roll and be drawn into the die opening during bending.

When carrying out the method in this way, care must of course be taken to ensure that the plate does not move between the first and second bending steps. If the plate should move (for example due to any springback that occurs after bending), the force applied by the second punch in the second bending step may not be in the same place of the sheet, which will lead to an imperfect bend being formed.

To avoid this occurring, it is preferable to include a registration means to ensure that the plate is properly aligned at the start of the second bending step. Suitable means may comprise a clamp that hold the plate in place while the first bending punch is removed and the second bending punch is installed. Alternatively, the registration means may comprise a mark on the plate such as a notch, ink pattern or the like that can be aligned with a similar mark on the die.

An alternative way of carrying out two discrete and separate bending steps would be to physically move the plate from the first to the second die after the first bending step. However, such methods are cumbersome and also increase the likelihood that the plate is not properly positioned during the second bending step. Again, this could lead to the second bending force being applied to a different part of the plate, which would lead to an imperfect bend.

To avoid the issues that arise from improper registration when using discrete bending steps, it is preferred to use a process in which the first and second bending forces are continuous. In other words, a process which uses one bending punch (i.e. the first and second bending punch are the same), and wherein the bending punch continuously applies a force on the plate from the beginning of the first bending step to the end of the second bending step. The force could be continuously applied at a level sufficient to cause the plate to bend, or the force could be reduced at the end of the first bending step to a level sufficient to hold the plate in place while the die width is being adjusted.

In order for the method of the disclosure to be carried out in a continuous bending step with a force applied at a level sufficient to cause bending throughout the method, a nested double die may be used in which the second die resides below and within the first die, the first and second die being aligned such that the planes formed by the die supports of the first and second dies are parallel, and such that the midpoint of the first die and second die lie in the plane traversed by the bending punch. Using such an arrangement, the bending punch can carry out the first bending step and initially bends the plate in a wide bend (i.e. a large radius of bend performed by so called "free bending") due to the large die width of the first die. Once the plate is bent to the extent that it contacts the second die, the first bending step ends and the second bending step immediately begins. The bending punch then applies the bending force using the narrower die to achieve the desired radius and final bend angle, allowing for springback in the usual way.

Figure 4A:
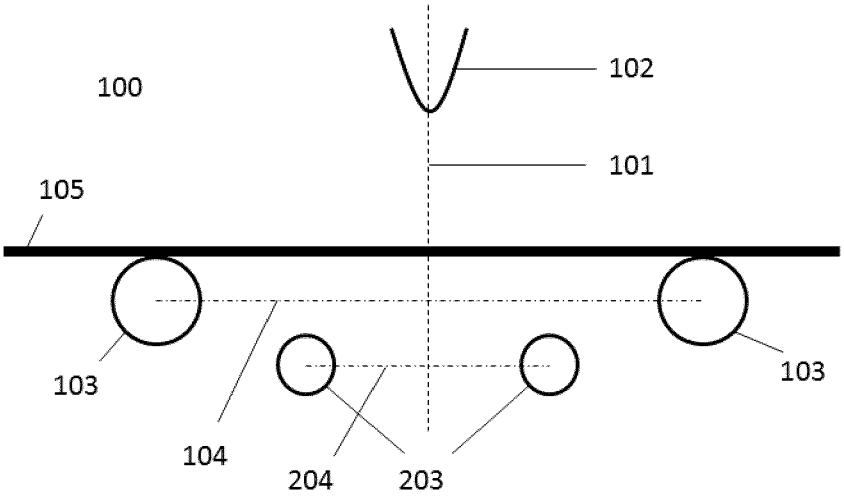
FIG. 4 shows a schematic of the continuous bending step in an embodiment wherein a nested double die is used.
Figure 4B:
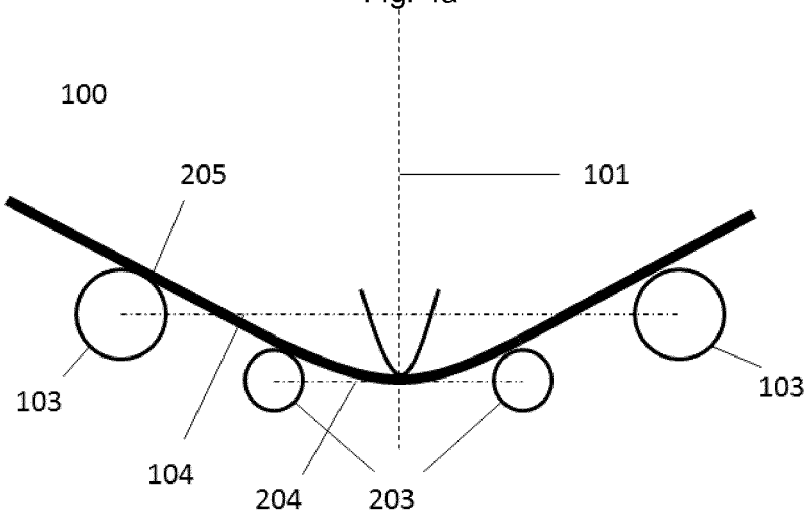
Figure 4C:
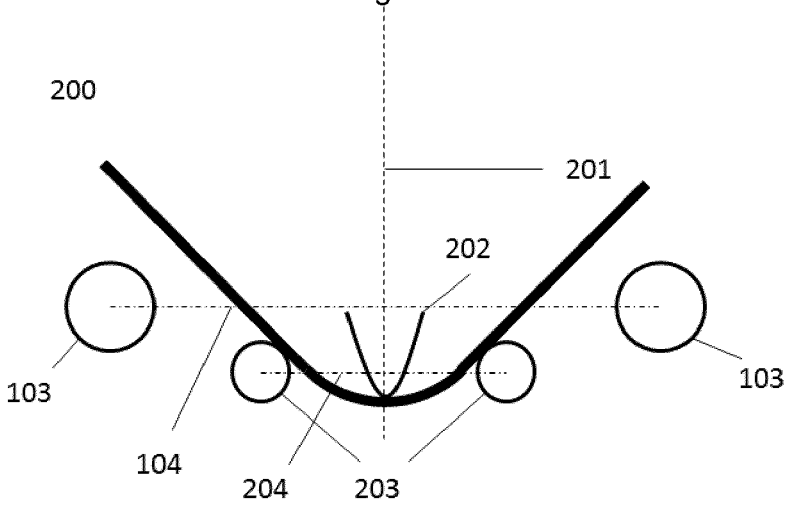

A schematic nested double die is shown in FIGS. 4*a*-4*c*. In FIG. 4*a*, the plate of material 105 is supported on a first die 103 having a first die width 104. The bending apparatus also includes a second die 203 located below and within the first die 103 to provide a nested double die, wherein the second die width 204 is less than the first die width.

In the first bending step 100, the first bending punch 102 applies the first bending force 101 on the metallic plate 105 to provide a bent metallic plate 205 as shown in FIG. 4*b*. At the end of the first bending step, the bent metallic plate 205 comes into contact with the second die 203 having the second die width 204. As the bending force 101, 201 is continually applied by the bending punch 102, 202, the plate continues to bend within the second die 203 to form the final bend.

Figure 5A:
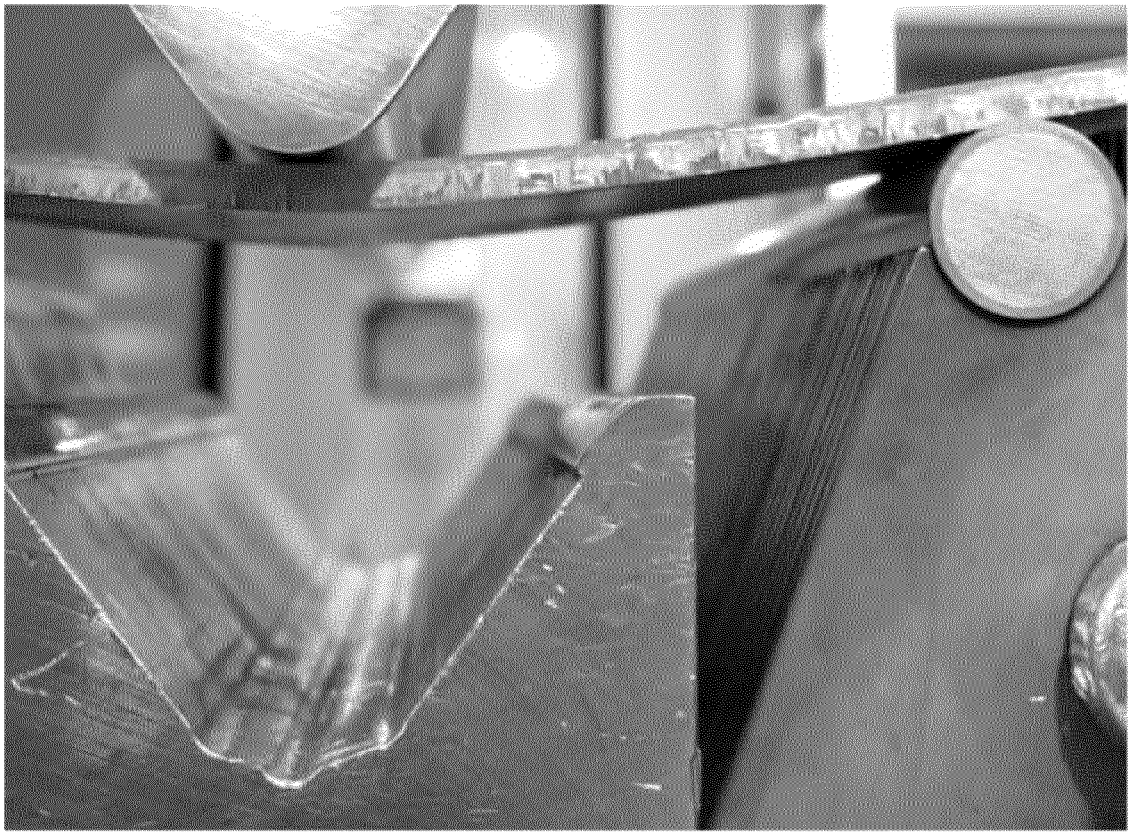
FIG. 5 shows the actual bending of a metallic plate using a nested double die.
Figure 5B:
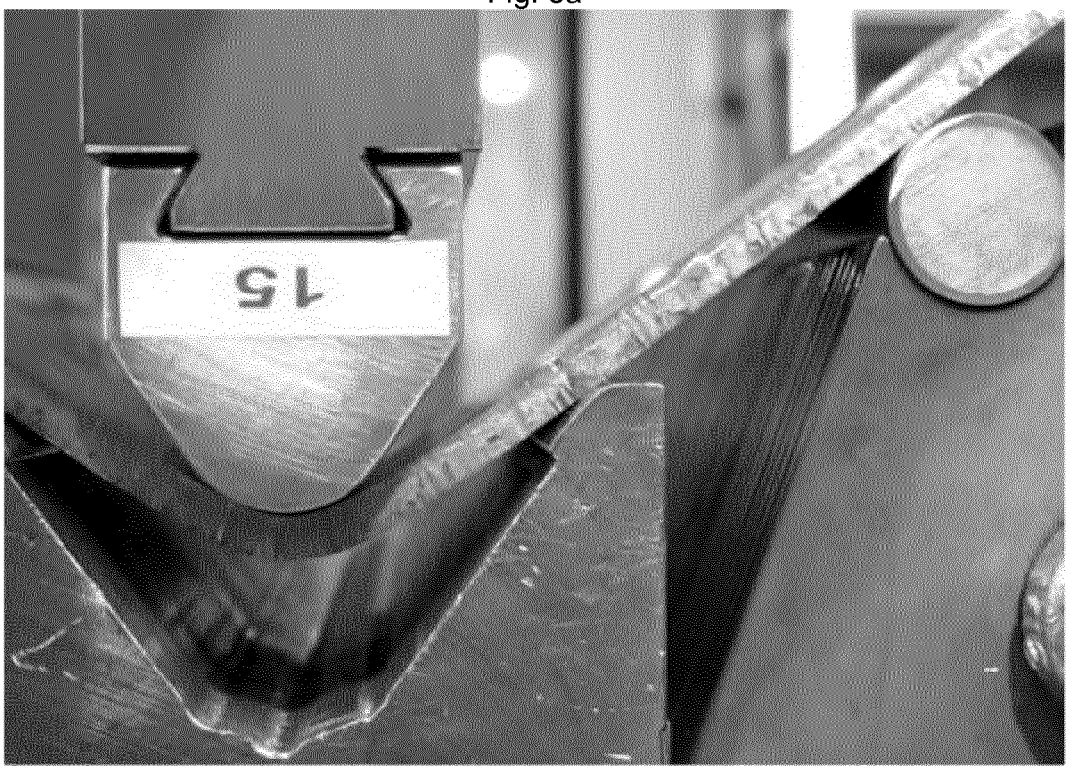
Figure 5C:
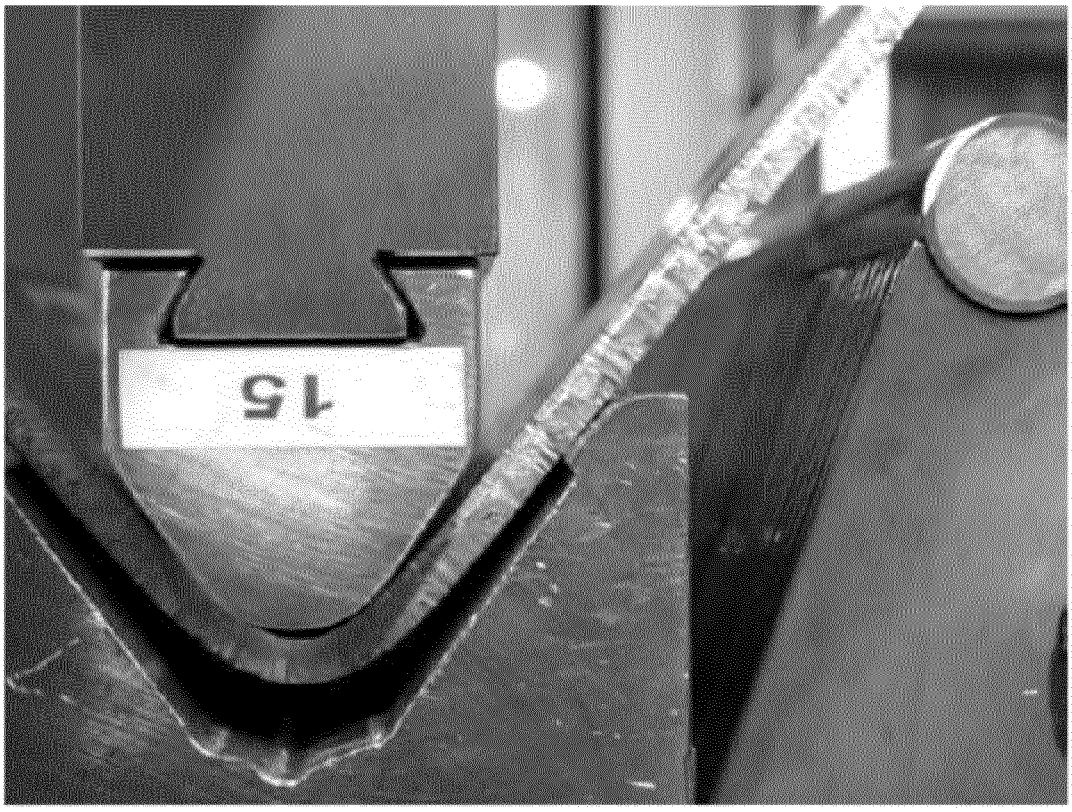
Figure 5D:
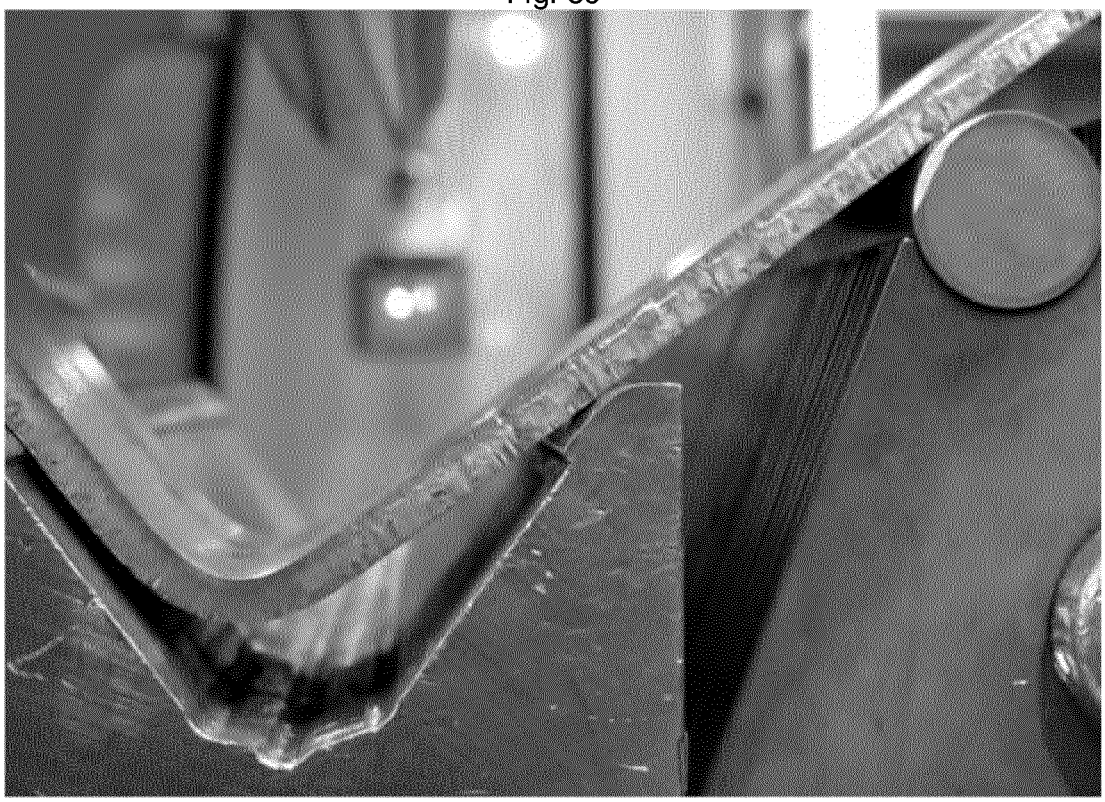

FIGS. 5*a*-5*d* show an actual nested double die being used in a bending method according to the disclosure. Thus, in FIGS. 5*a* and 5*b*, the first bending force is applied until the plate of material comes into contact with the second die. At that point, the bending moment experienced by the plate is provided by the second, inner die and the bending punch. FIG. 5*c* shows the plate bent into its final configuration, before the bending punch is removed in FIG. 5*d* and the plate relaxes due to springback.

As an alternative to using a nested double die as described above, an adjustable die may be used. For example, in one embodiment the adjustable die may be set to the first die width and the first bending force applied for the first bending step; the bending force may be reduced and the die width adjusted to the second die width (for instance, the bending force may be reduced to a level sufficient to retain the plate in position while the die width is adjusted to the second die width); then the second bending force applied in the second bending step.

An issue that can arise when adjusting the die width is that the plate is forced upwards as the die width reduces, which is a natural consequence of the point of contact with the edges of the die moving along the curve of the plate towards the centre. If the bending punch is static while the die width is being reduced, this leads to a bending moment being created as the die forces the plate up into the die. In order to avoid this occurring, it is preferable that the bending punch is able to move upwards as the die width is being adjusted.

Preferably, the only force applied while the die width is adjusted corresponds to the weight of the bending punch. This is typically a large enough force to hold the plate in position while the die width is being adjusted, but small enough that the punch can be lifted as the plate is pushed upwards.

Figure 6A:
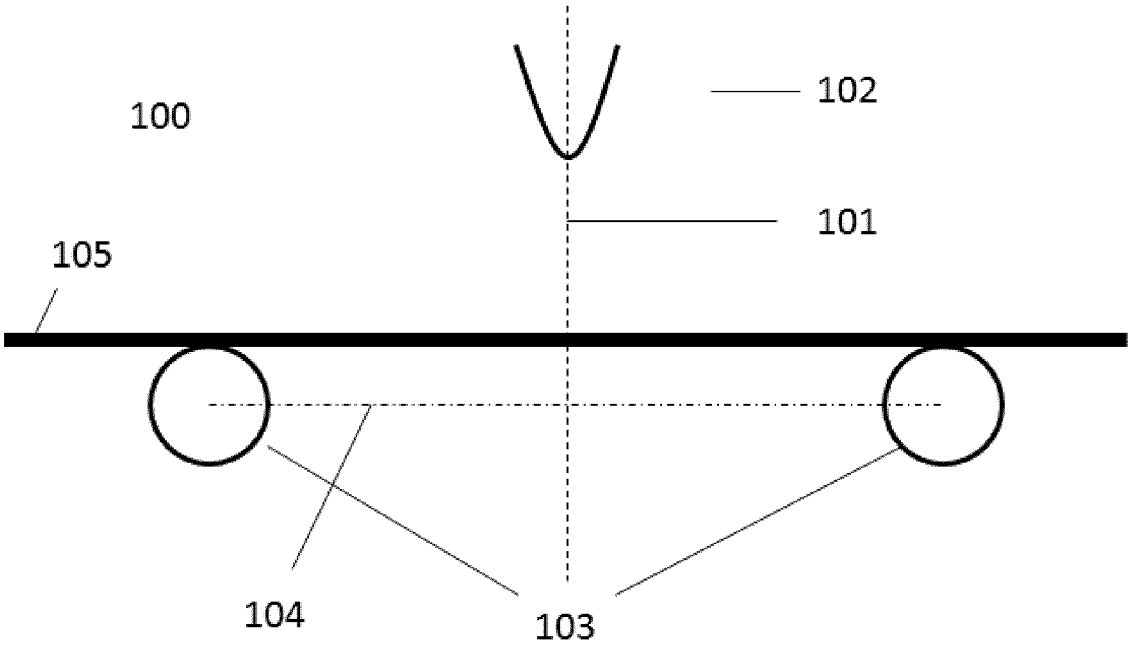
FIG. 6 shows a schematic of the first bending step in a process in which an adjustable die is used.
Figure 6B:
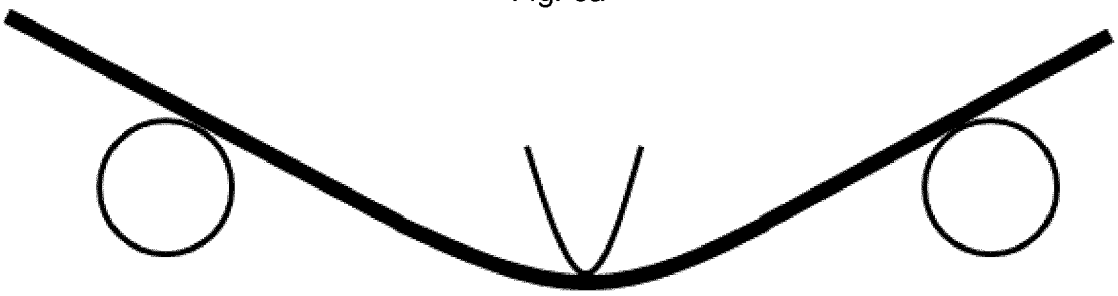
Figure 7A:
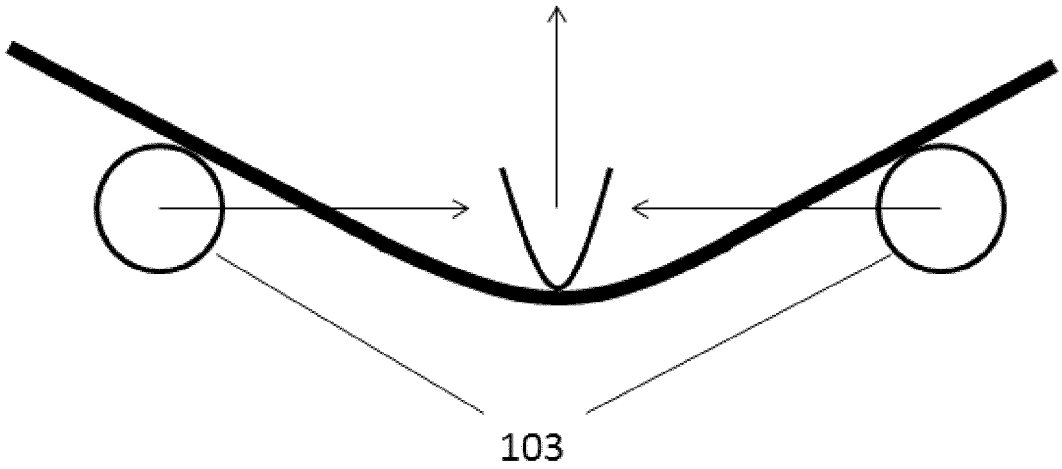
FIG. 7 shows a schematic of the die width being adjusted prior to initiation of the second bending step.
Figure 7B:
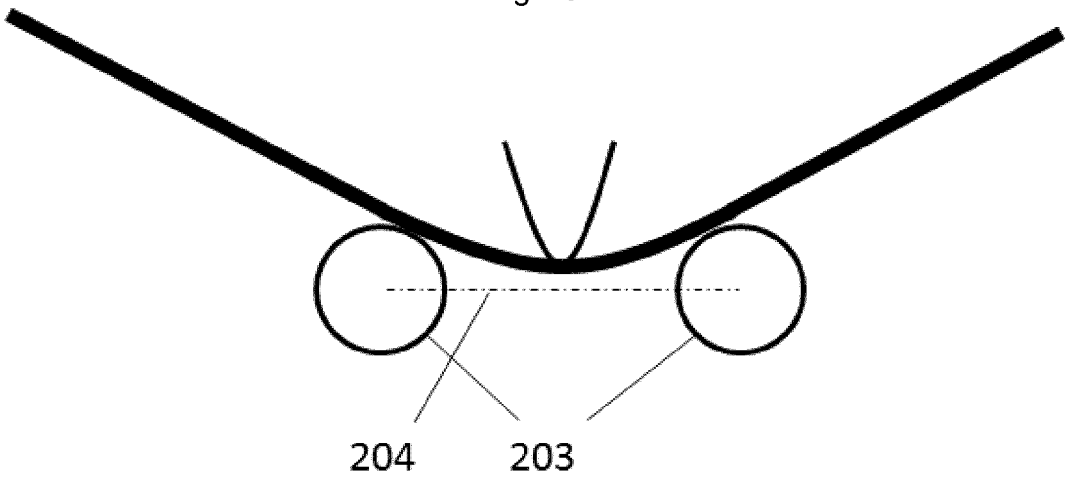
Figure 8:
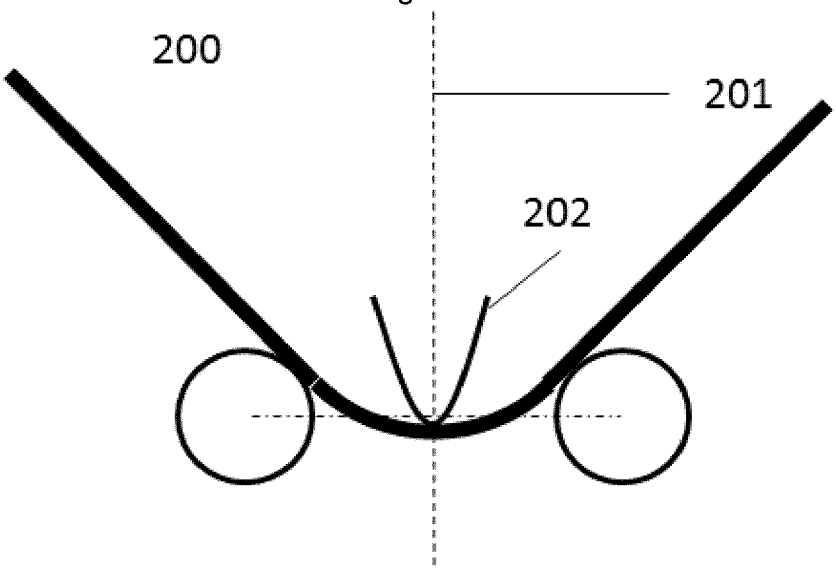
FIG. 8 shows a schematic of the second bending step being carried out on the narrower die width.

Such an embodiment is schematically shown in FIGS. 6-8. Thus, in FIG. 6*a*, the plate of material 105 is positioned on a first die 103 having a first die width 104. In a first bending step 100, the first bending force 101 is applied via bending punch 102 to provide a bent metallic plate (FIG. 6*b*). When the desired level of bend is reached, the first bending force is reduced and the first die width 104 adjusted to the form the second die 203 having the second die width 204 (see FIGS. 7*a* and 7*b*). The second bending step 200 then starts, with the second bending force 201 being applied by the bending punch 202 to provide the final bent plate (see FIG. 8).

Another solution to overcome the issues caused by the adjustable die forcing the plate upwards is to provide a height adjustment means such as a spring or a piston. When reducing the force after the first bending step, the height adjustment means urges the adjustable die and plate against the bending punch, holding it in place. As the die width is reduced, any movement required to avoid the plate being bent is accommodated by the height adjustment means. Once the die width has been adjusted, the bending punch then applies the second bending force, with the height adjustment means if necessary accommodating any further movement of the plate to the bending beginning.

The height adjustment means may be incorporated into the support mounting the adjustable die, or into the bending punch, or both. It should be noted that the expression "height" as used throughout this disclosure refers to the perpendicular distance from the plane formed by the die opening, and does not necessarily need to be a vertical distance.

Figure 9A:
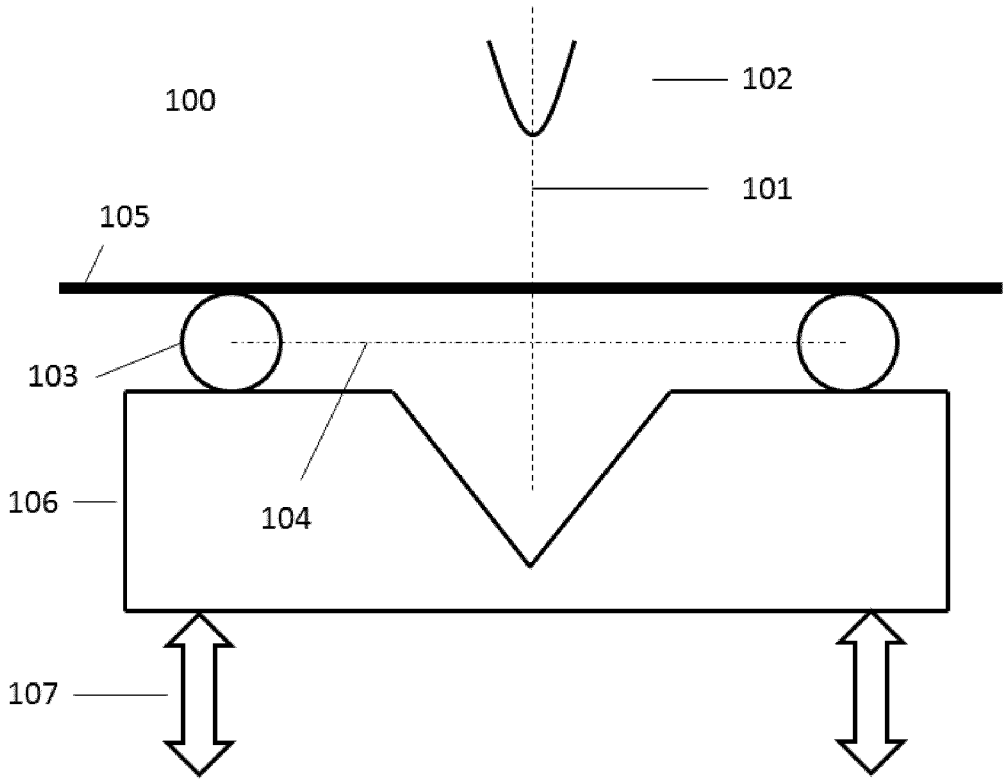
FIG. 9 shows a schematic of the height adjustment means accommodating the first bending force prior to the metallic plate being bent in the first bending step.
Figure 9B:
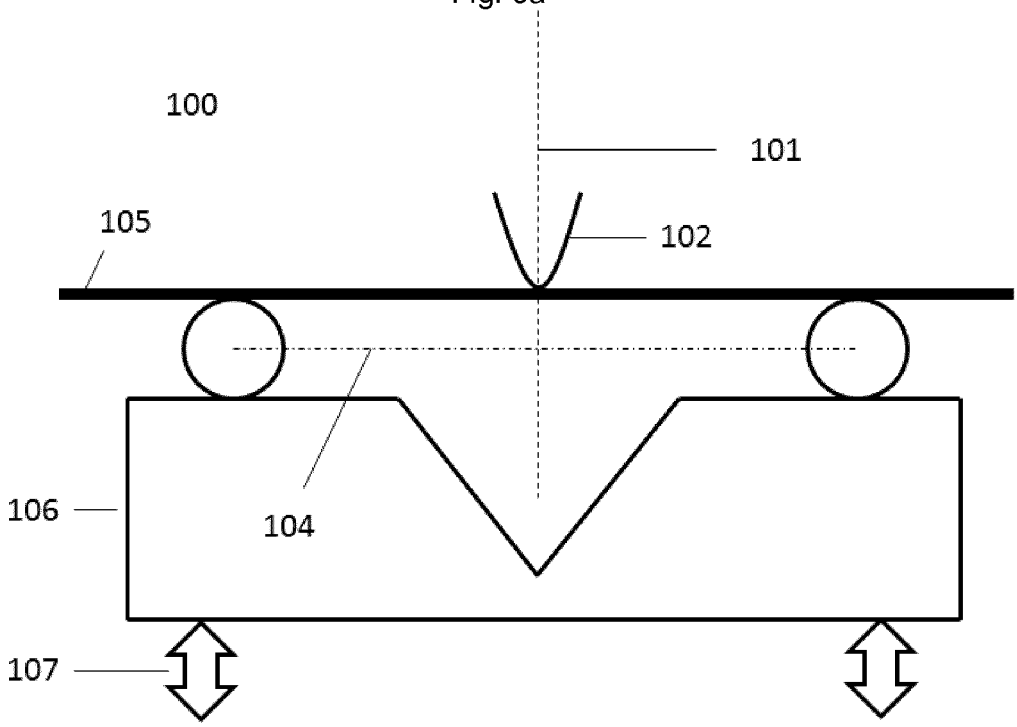
Figure 10A:
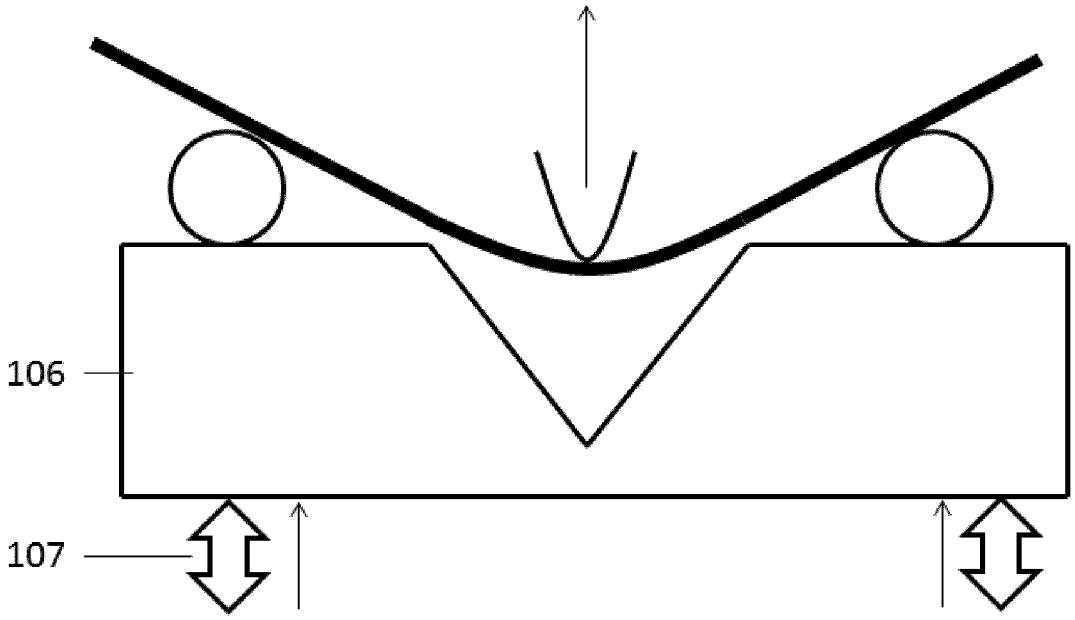
FIG. 10 shows a schematic of the height adjustment means accommodating any movement of the die support while the die width is being adjusted.
Figure 10B:
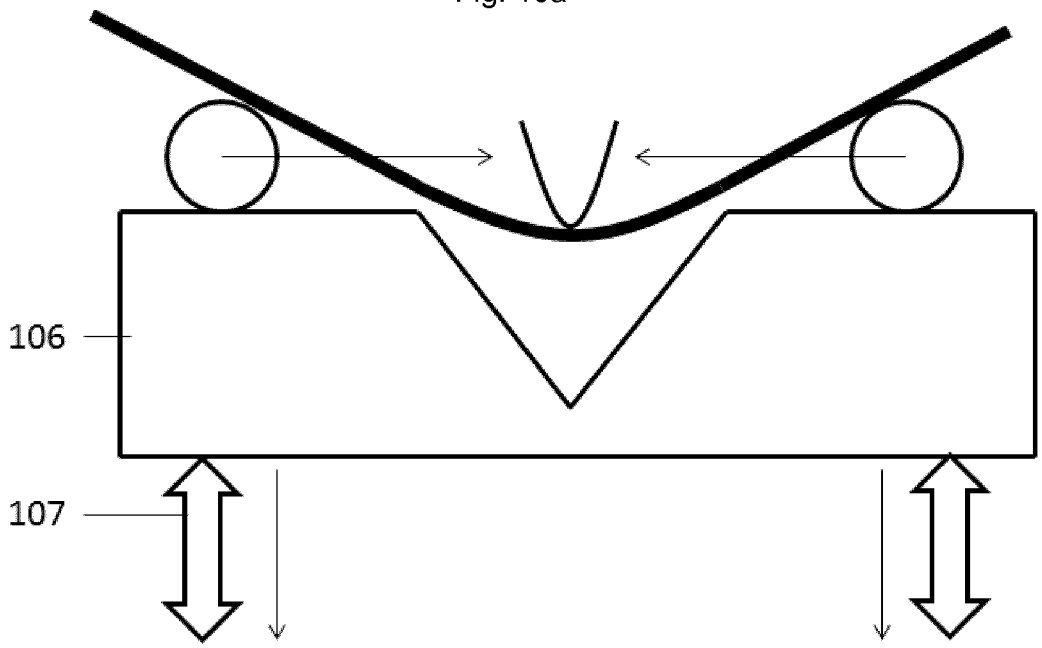
Figure 11A:
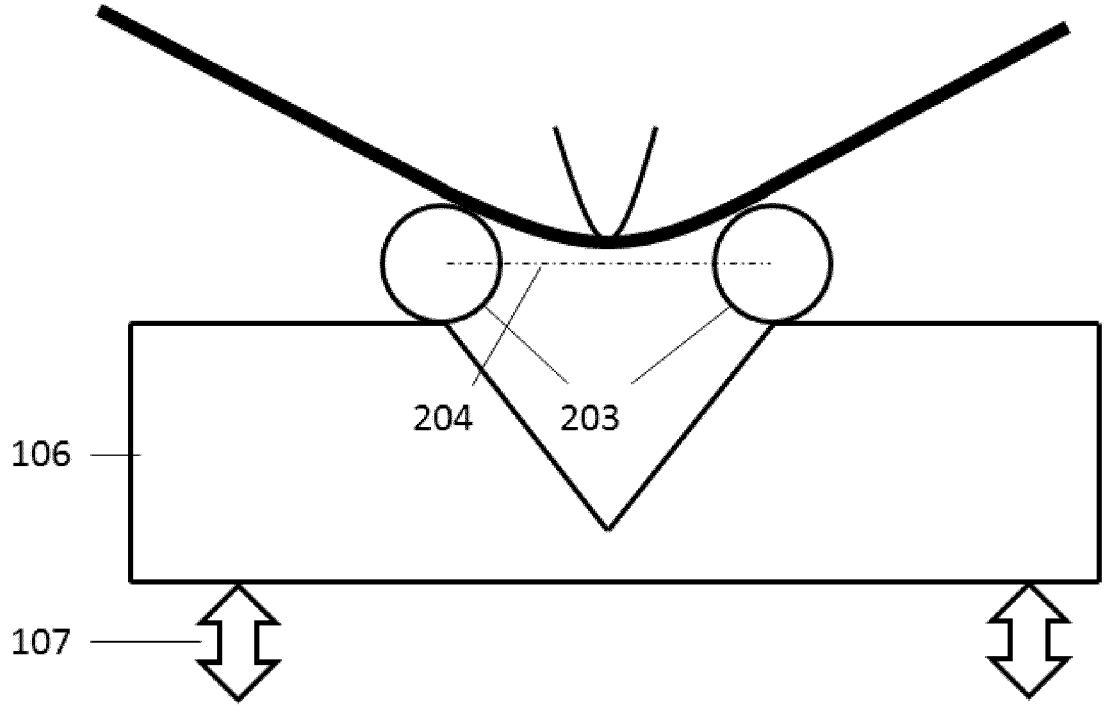
FIG. 11 shows a schematic of the second bending step being carried out on the narrower die width.
Figure 11B:
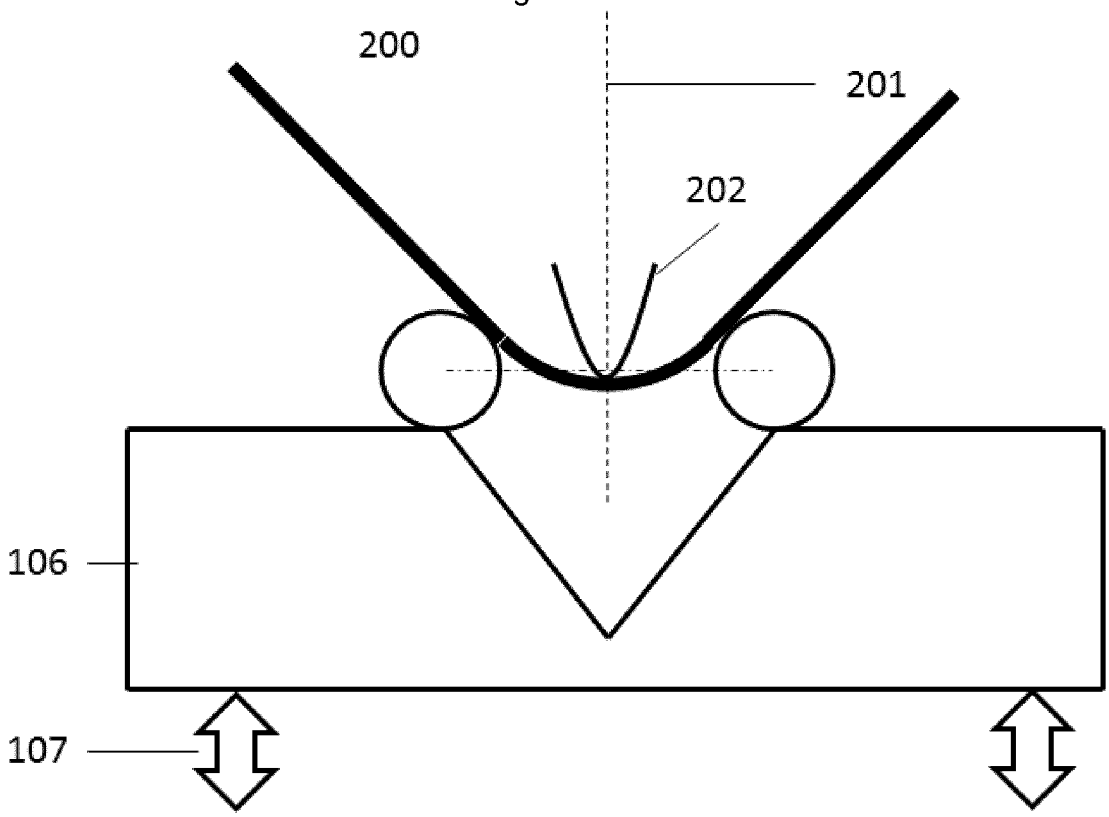

A height adjustment means incorporated into the support mounting the adjustable die is shown schematically in FIGS. 9-11. Thus, FIG. 9*a* shows the first die 103 is mounted on height adjustment means 107 via an optional support 106. As the bending punch 102 is brought into contact with the plate of material 105, the initial bending force 101 is optionally absorbed by the height adjustment means 107 (see FIG. 9*b*). The bending force 101 then bends the plate 105 to provide a bent plate (FIG. 10*a*). The bending force is then reduced such that the bending punch moves upwards, with the plate remaining urged against the punch as it lifts up due to the height adjustment means 107 which moves the die and optional support upwards (see FIG. 10*a*). The first die width is then adjusted to form the second die 203 having the second die width 204 (see FIG. 10*b*). As the adjustment of die width takes place, the punch remains in position and the height adjustment means 107 compensate for any movement caused by the die moving down the bend of the plate (see FIG. 10*b*). Once the second die width 204 has been reached, the second bending force 201 can be applied by the bending punch 202 in the second bending step 200 to form the final bent plate (see FIG. 11).

An additional way of accommodating the movement of the plate that occurs while the die width is adjusted is to incorporate the height adjustment means in the bending punch. Such a bending punch may comprise a contacting portion, a force providing portion, and a height adjustment means connecting the force providing portion to the contacting portion.

Thus, the contacting portion is the part of the punch that is in contact with the plate which is being bent. The force providing portion is capable of exerting a force via the contacting portion to the plate, while the height adjustment means is capable of adjusting the distance between the contacting portion and the force providing portion. Typically, the height adjustment means may comprise a compressible spring or piston or any other resilient and/or displaceable element.

Typically, the force providing portion is capable of physically moving to exert the force via the contacting means on the plate. However, it is possible that the force providing portion exerts the force on the contacting portion via the height adjustment means. An example of such an embodiment would be if the height adjustment means was a piston, such that the end of the piston rod comprised the contacting means, and the piston cylinder comprised the force providing portion, the piston rod itself corresponding to the height adjustment means.

Figure 12A:
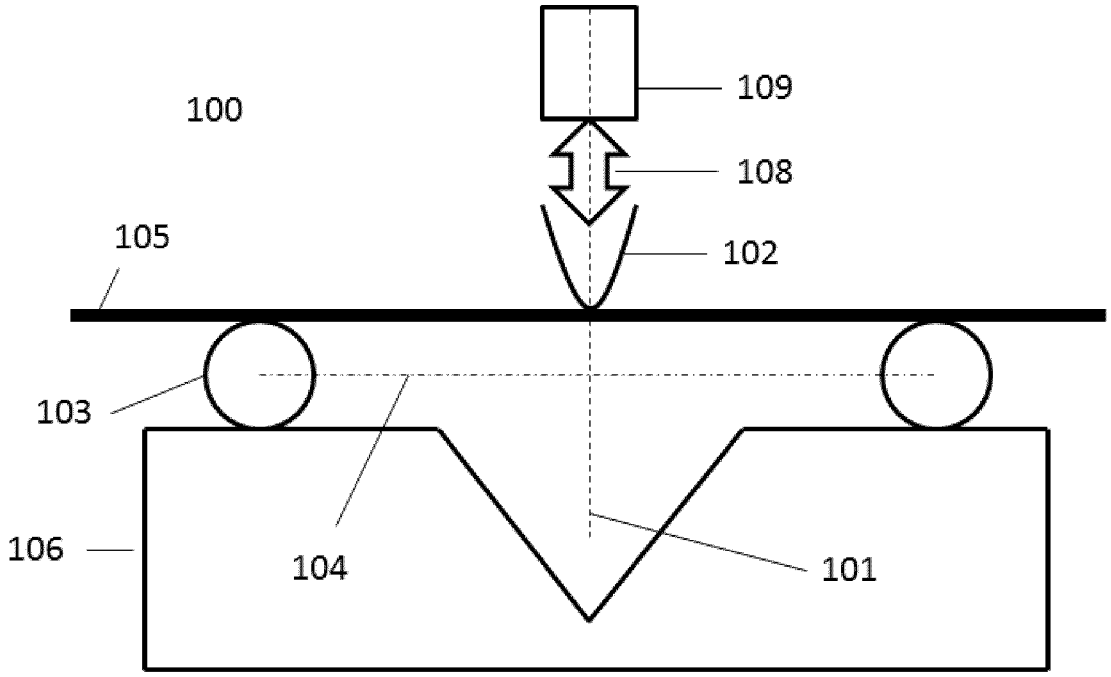
FIG. 12 shows the first bending step in a method where the height adjustment means is integral to the bending punch.
Figure 12B:
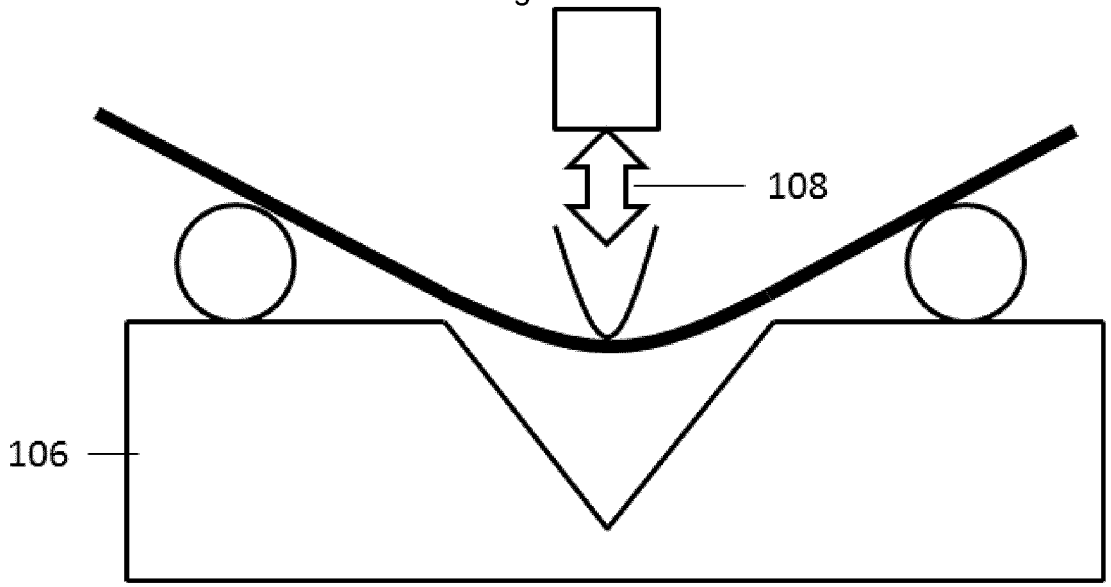
Figure 13A:
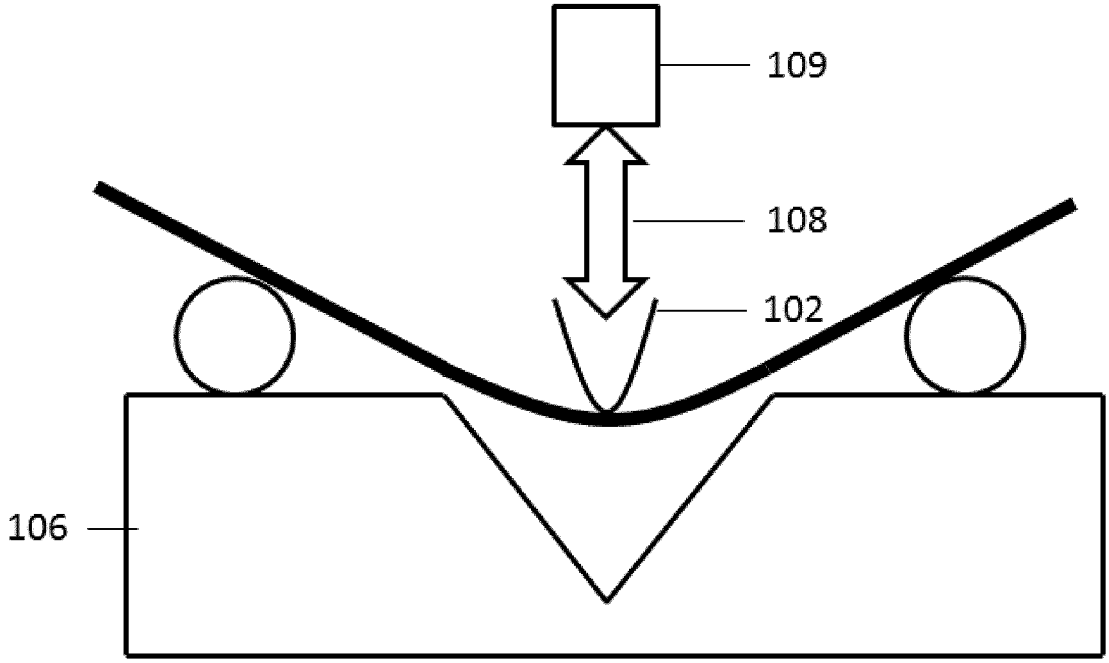
FIG. 13 shows the adjustment of the die width being accommodated by the height adjustment means in the bending punch.
Figure 13B:
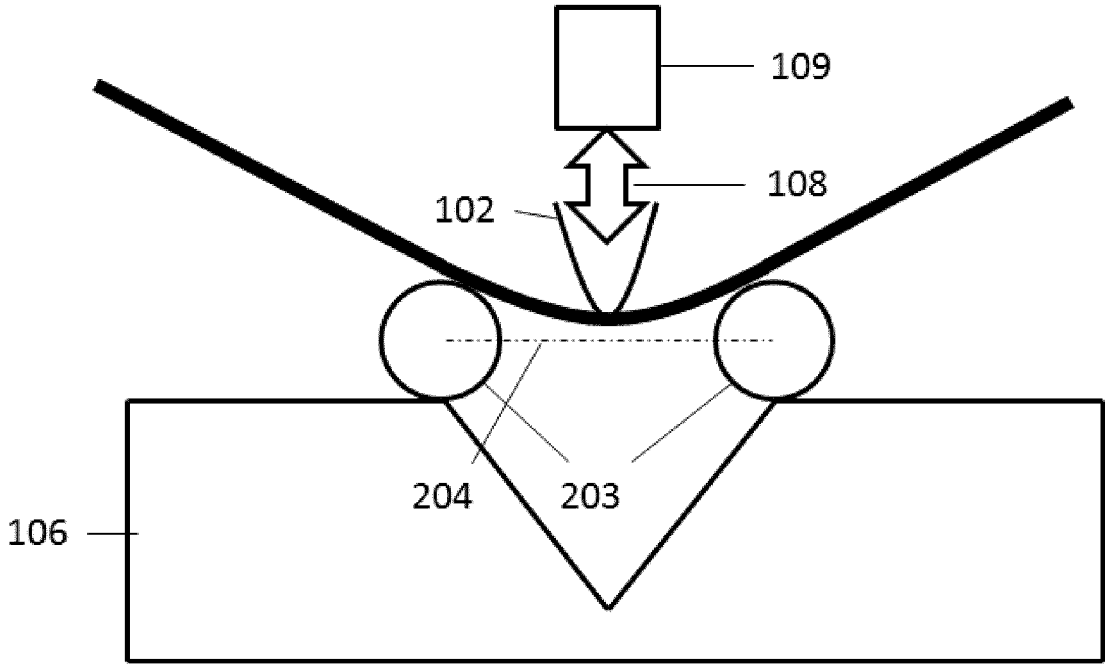
Figure 14:
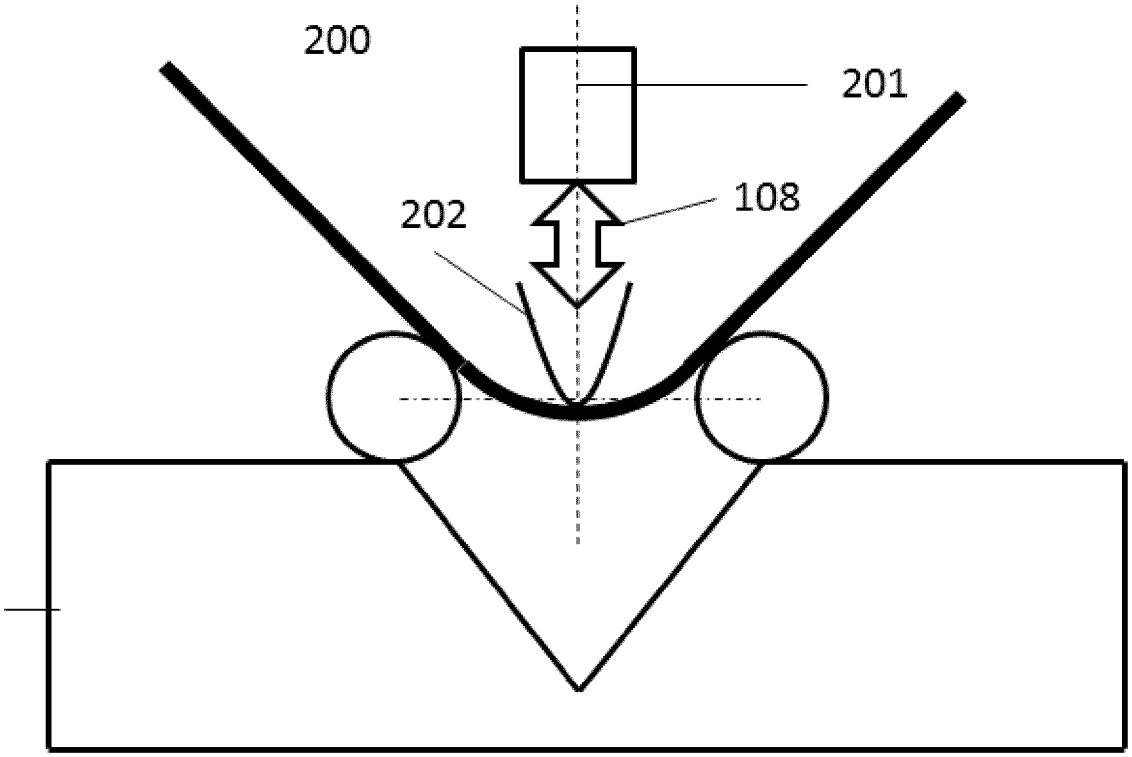
FIG. 14 shows the second bending step being carried out using the narrower die width.

An example of an embodiment with the height adjustment means in the punch is shown schematically in FIGS. 12 to 14. Thus, FIG. 12*a* shows a first die 103 mounted on a support 106. The bending punch comprises the contacting portion 102, the height adjustment means 108 and the force providing portion 109. In the first bending step, force providing means 108 urges the contacting portion 102 of the punch against the plate 105, forcing it into the die 103 having the first die width 104 to provide a bent plate as shown in FIG. 12*b*.

In FIG. 13*a*, the height adjustment means 108 is extended to increase the distance between the force providing portion 109 and the contacting portion 102 of the bending punch. In this configuration, the force providing portion is raised while the contacting portion remains in contact with the plate. The die width is then adjusted to provide the second die 203 having second die width 204 (see FIG. 13*b*). During this adjustment, the height adjustment means 108 allows the contacting portion 102 of the bending punch to move upwards towards the force providing portion 109 as the plate is pushed upwards. FIG. 14 then shows the second bending step being carried out to provide the final bent plate.

Figure 15:
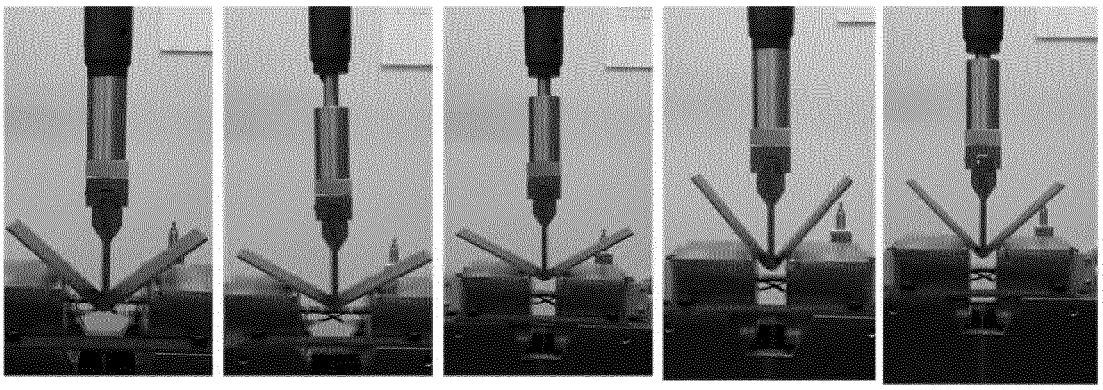
FIG. 15 shows pictures of an actual bending punch having a height adjustment means carrying out the die adjustment and second bending steps in a method of the disclosure.

FIG. 15 shows a photographic series of a bending punch having this configuration after the first bending step (step A). The height adjustment means ensures the contacting portion remains in contact with the plate as the force providing portion is raised in step B. Step C shows the die width being adjusted, with the upward movement of the plate being accommodated by the height adjustment means. Step D shows the second bending step, while in step E the bending punch is raised to allow for springback.

Preferably, the method of the disclosure is characterised by the second die width is less than the first die width.

Preferably, the first bending punch is used as the second bending punch in the second bending step. In such embodiments, it is preferred that the first bending punch applies a force on the plate continuously from the start of the first bending step to the end of the second bending step.

While in principle, improved results will be achieved when using the method of the disclosure, it is of course preferred to optimise the method to achieve the best results. Thus, the typical strain of the outer fibres of the bend at the end of the first bending step is from 2% to 9%, more preferably from 2% to 8%, more preferably from 2% to 6%, more preferably from 2% to 5%, most preferably from 2.5% to 4.5%.

In some embodiments, the strain of the outer fibres of the bend at the end of the first bending step is from 3% to 7%, preferably from 4% to 6%.

For the purposes of the present disclosure, the strain, E, may be calculated using the following equation:

$$\varepsilon = \frac{\alpha \cdot t}{W_1}$$

Wherein $\alpha$ is the bending angle, t is the plate thickness, and $W_1$ is the first die width (which corresponds to twice the initial moment arm). FIG. 16 shows a schematic representing a and $W_1$. Although this value is only an approximation of the true strain, the values of "strain" as referred to herein should be calculated using this equation.

By "bending angle" is meant the angle, a, to which the plate is bent. As the point of the bend is actually a curve, the bending angle corresponds to the hypothetical angle that arises where the planes of the non-bent portions of the plate coincide, wherein $\alpha$ varies from 0° for a non-bent plate to 180° for a perfectly folded plate. This of course also corresponds to the angle formed by the two normal vectors to the planes of the non-bent portions of the plate. The bend angle $\alpha$ is shown schematically in FIG. 3*b* and FIG. 16.

The bend angle $\alpha$ can be calculated from simple geometry using suitable formula known in the art. For completeness, a suitable formula for calculating $\alpha$ is:

$$\alpha = 2 \cdot \mathrm{Sin}^{-1}\left(\frac{\left[L_0 \cdot Q + \sqrt{L_0^2 + (S-Q)^2 - Q^2} \cdot (S-Q)\right]}{[L_0^2 + (S-Q)^2]}\right) \cdot \frac{180}{\pi}$$

wherein $L_0$ is the half die width (i.e. half of $W_1$), $Q = R_k + R_d + t$ $R_k$ is the punch radius $R_d$ is the radius of the die edge (roller radius)

t is the sample thickness, and

S is the distance through which the bending punch has been displaced.

By "radius of the punch" and "radius of the die edge" is meant the radius of the curved part of the punch/die edge that is in contact with the material being bent.

As would be evident to the skilled person, the final term ($180/\pi$) in the above formula merely converts the result from the arcsin function from radians to degrees. This term is a scalar, and not decisive in calculating $\alpha$.

It is clear from the strain equation above that the strain is proportional to the plate thickness, and inversely proportional to the first die width. As a consequence of this relationship, as the first die width increases, the strain induced for a given bending angle is lower. This consequently means that a larger bending angle is needed to achieve the optimum strain in the first bending step.

Likewise, as the plate thickness increases, the strain for a given bending angle increases accordingly. This means that thicker plates require a smaller bending angle in order to achieve the optimum strain in the first bending step.

These relationships can nevertheless be quantified by developing the expression for strain. For instance, rearranging the above expression, the die-width for the outer-die may be estimated as:

$$W_1 = \frac{\alpha \cdot t}{\varepsilon}$$

$W_1$ can also be expressed by the ratio between inner- and outer-die, $$\frac{W_2}{W_1},$$

as:

$$w_1 = \frac{1}{\frac{W_2}{W_1}} \cdot W_2$$

Combining these two equations gives:

$$\alpha = \frac{1}{\frac{W_2}{W_1}} \cdot \varepsilon \cdot \frac{W_2}{t}$$

These equations can be used to calculate the bending angles necessary to achieve a given strain, relative to the material's thickness and die widths. It is also possible to calculate the vertical displacement (height differential) for a given bend angle, for instance by using the known equations for a set out above. From these equations, the geometry of the nested double die which is necessary to achieve a given strain for a given material thickness may be calculated and optimised as necessary.

Figure 21A:
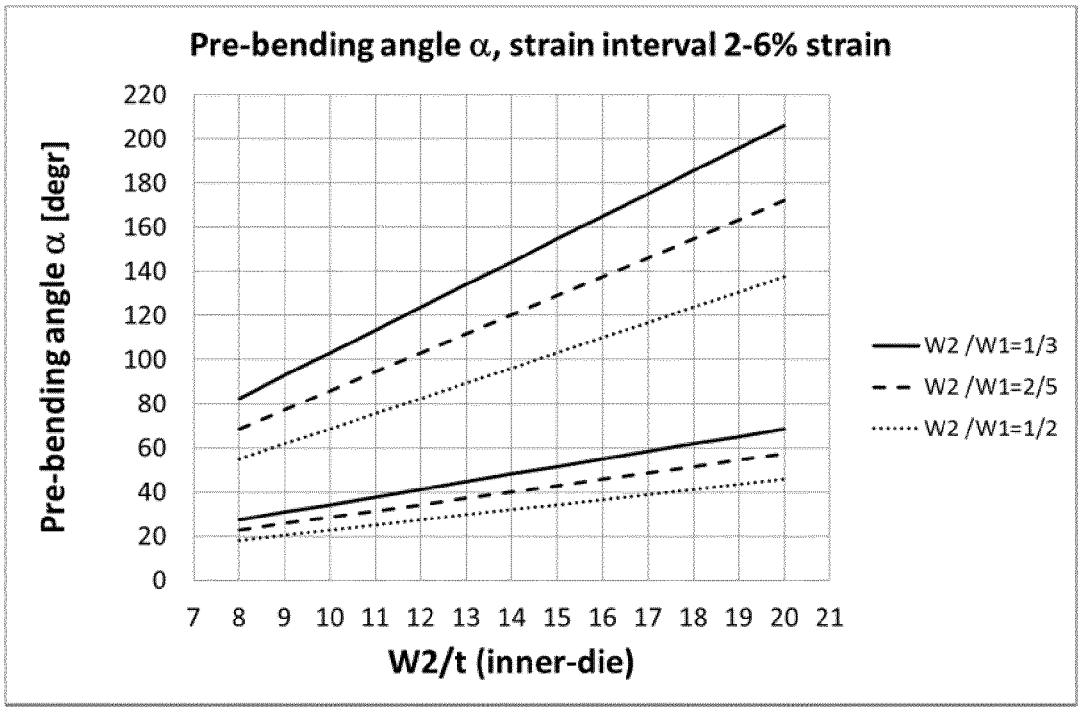
FIG. 21A is a plot of pre-bending angle α versus $W_2$/t for strain levels of 2% and 6%.
Figure 21B:
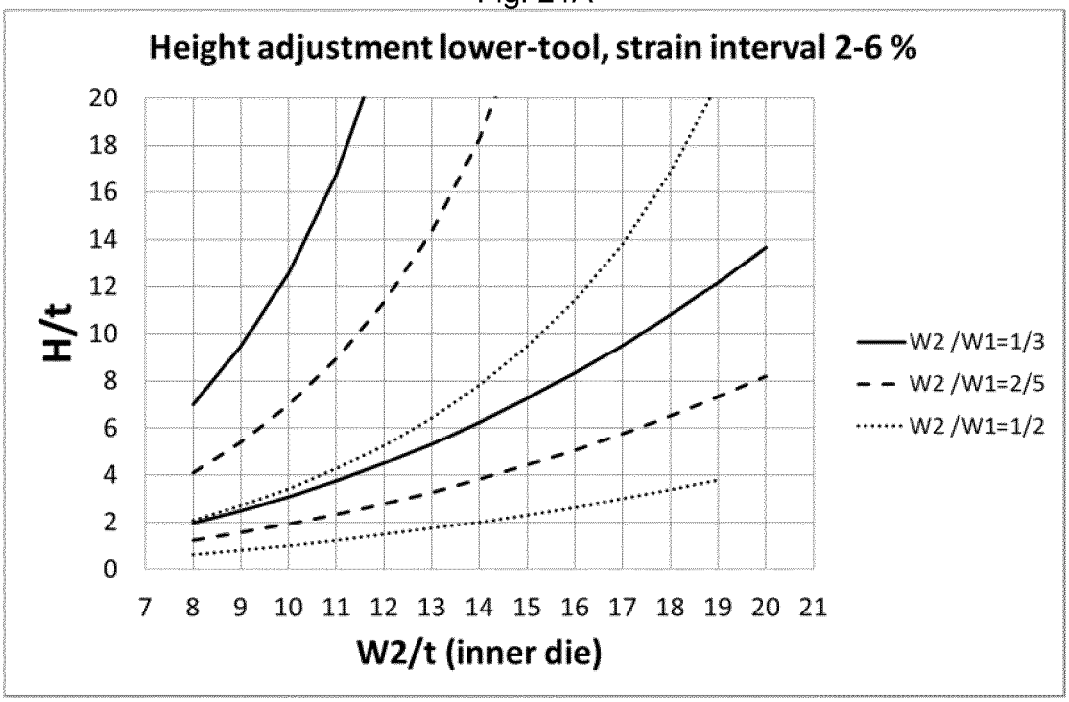
FIG. 21B is a plot of H/t versus $W_2$/t for strain levels of 2% and 6%.
Figure 22A:
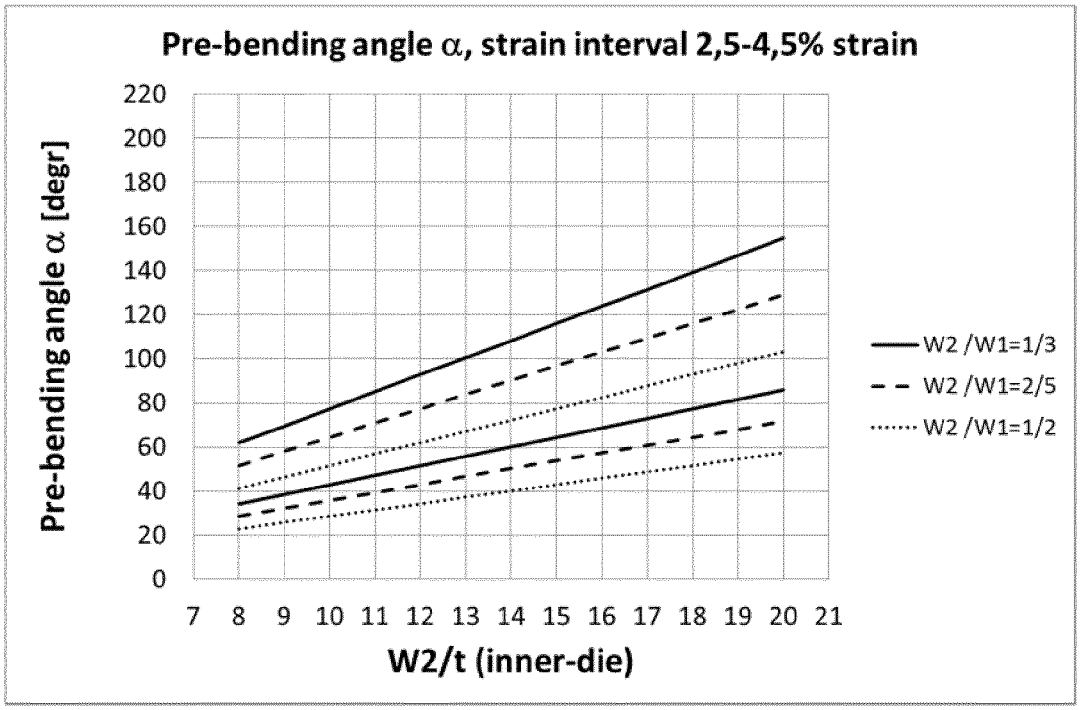
FIG. 22A is a plot of pre-bending angle α versus $W_2$/t for strain levels of 2.5% and 4.5%.
Figure 22B:
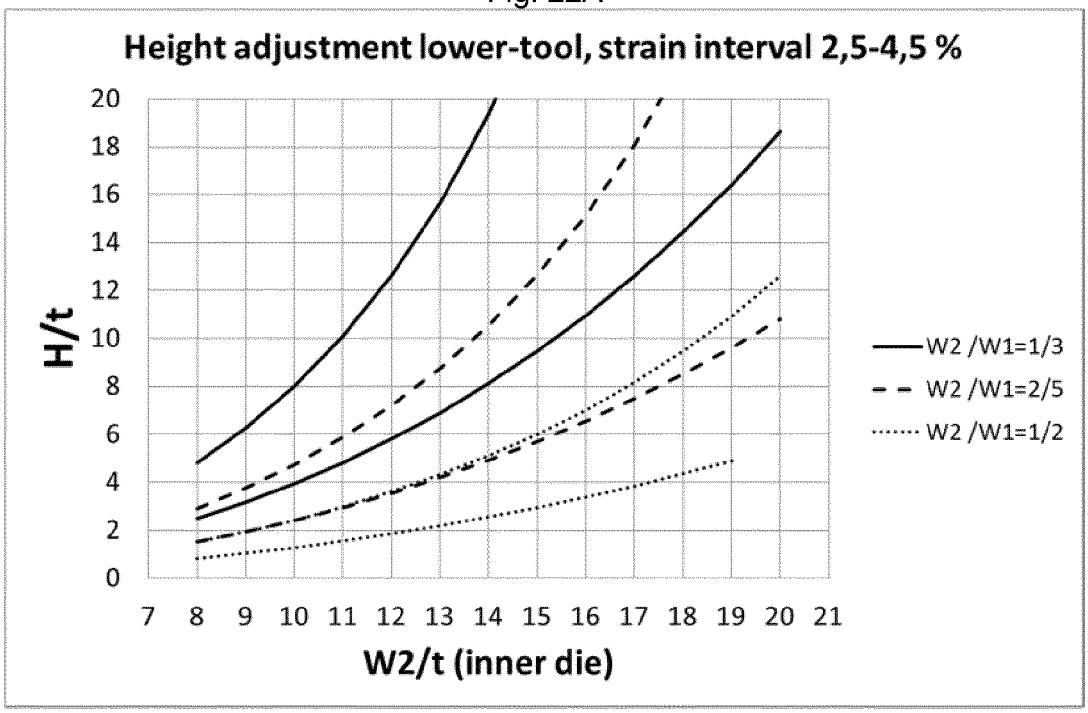
FIG. 22B is a plot of H/t versus $W_2$/t for strain levels of 2.5% and 4.5%.

By way of guidance, FIG. 21A shows the pre-bending angle α for a strain interval of 2% (lower lines) and 6% (upper lines) for various typical ratios of die widths ($W_2/W_1$=⅓, ⅖, and ½) for various thicknesses of material (relative to the inner die width). FIG. 21B shows a similar plot, but instead of bending angle α, the value H/t is plotted. FIGS. 22A and 22B are identical, but for strain levels of 2.5% and 4.5%.

FIGS. 21A and 22A show a large variation in possible bending angles at the end of the first bending step. Despite these variations, typically the bending angle after the first bending step is at least 15°, preferably at least 20°, preferably at least 25°, more preferably at least 30°, more preferably at least 40°.

The bending angle after the first step is typically at most 120°, preferably at most 100°, more preferably at most 85°.

Possible ranges of bending angles for the first step include from 15° to 120°, alternatively from 20° to 100°, alternatively from 30° to 100°, alternatively from 50° to 120° more preferably from 60° to 100°, even more preferably from 65° to 85°.

It is evident from FIGS. 21A and 22A that the bending angle is dependent on the material thickness, or more particularly the ratio of inner die width to material thickness.

For a tight die-width, e.g.

$$\frac{W_2}{t} = 8,$$

which is even smaller than what is typically recommended, the bending angles at the end of the first bending step will typically be around 20° to 60°, depending on the width of the outer-tool.

When applying a large die, $$\frac{W_2}{t} = 20,$$

the bending angles at the end of the first bending step will typically be larger, such as around 60° to 155°.

However, in case of bending high strength material aiming for a tight bending radius, the most common die-widths used is $$10 \leq \frac{W_2}{t} \leq 13.$$

When using these die-widths, pre-bending angles will typically be within following range:

$$30° \leq \alpha \leq 100°$$

Due to these variations (in particular the material being bent), it may be necessary to adjust the height (i.e. vertical displacement) of the second die relative to the first die when using a nested double die, achieving the optimal bending angle (within the ranges described above).

When using a nested double die (and typically the same bending punch for the first and second bending steps), the second die width is typically at least ¼ the first die width, preferably ⅓, more preferably ⅖, and most often about ½ the first die width.

In a similar manner, the second die width is typically at most ⅔ the first die width, preferably at most ⅗ the first die width.

When using a nested double die (and typically the same bending punch for the first and second bending steps), the second die width is therefore typically from ¼ to ⅔ of the first die width, preferably from ⅓ to ⅔ of the first die width, preferably ⅖ to ⅗, most preferably about ½ the first die width.

As shown clearly in FIGS. 21A and 22A, the pre-bending angle is lower when the ratio of inner and outer die is larger (i.e. as $$\frac{W_2}{W_1}$$

increases). If the size of we outer-die is set to, e.g.

$$\frac{W_2}{W_1} = 1/2,$$

then the approximate ranges for the pre-bending angle will typically decrease to approximately;

$$35° \leq \alpha \leq 65°$$

Typically, the die width for the final bending step is from 8 t to 20 t (where t corresponds to the plate thickness), preferably from 8 t to 15 t, preferably from 10 t to 13 t. Thus, when using a double die, the die width for the first die is typically about double this, or from 18 t to 30 t, preferably from 18 t to 27 t, more preferably from 20 t to 25 t (where t corresponds to the plate thickness).

Figure 17:
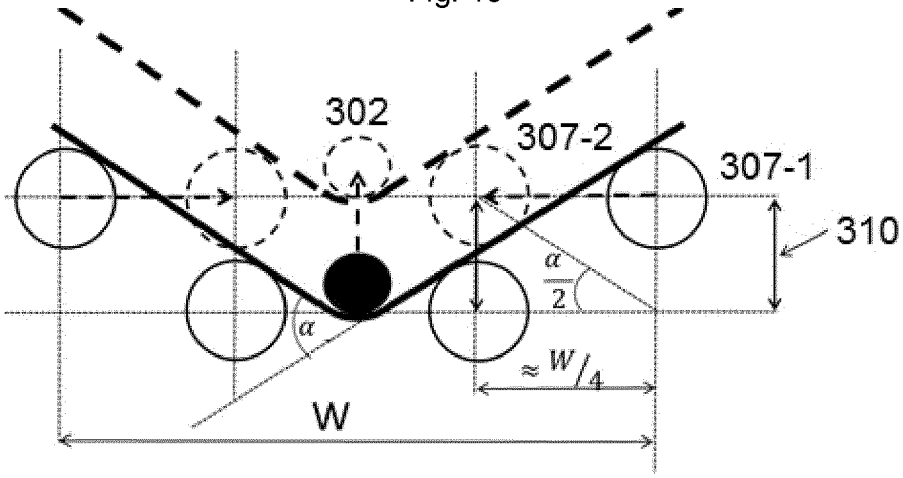
FIG. 17 is a schematic showing the movement of the bending punch and metal plate during the width adjustment step.

The height adjustment means must be capable of accommodating the movement of the plate that occurs as the die width is adjusted. The distance moved by the plate varies depending on the difference between the initial and final die width, and the bending angle, among other variables. When the second die width is half the first die width, the distance moved approximates to:

$$\frac{W_1}{4}\tan\left(\frac{\alpha}{2}\right)$$

Where $W_1$ corresponds to the die width of the first die and a is the bending angle after the first bending step. The origins of this formula can be understood from FIG. 17, in which the die moved from the first die position 307-1 to the second die position 307-2 along the dashed line, raising the bending punch 302 upwards 310.

The amount that the height adjustment means is required to move can be derived from the target strain after the first bending step (typically 2-6%) for the target die widths in relation to material thickness (e.g. 18 t$\leq W_1 \leq$30 t). To an extent, these height adjustments are therefore dependent on the target strain and the ratio of die width to material thickness.

Typically, the height adjustment means is capable of moving at least 4% of $W_1$, where $W_1$ is the die width of the first die, preferably at least 5% of $W_1$, more preferably at least 7.5% of $W_1$.

Preferably, the height adjustment means is capable of moving from 4% of $W_1$ to 55% of $W_1$, more preferably from 4% to 40% of $W_1$, more preferably from 5% to 35% of $W_1$.

In some embodiments, the height adjustment means is capable of moving from 10% of $W_1$ to 55% of $W_1$, more preferably from 15% of $W_1$ to 40% of $W_1$.

The method of the present disclosure can be used on any plate of material. Preferably, the material is ductile in the sense that it can be bent (i.e. it is malleable or pliable in the sense that it displays a degree of elasto-plastic behaviour on deformation), and is preferably able to retain its bent shape after the bending force is removed.

Particularly preferably, the material is a metallic material. The method of the disclosure can therefore equally be viewed as a method of forming a bend in a plate of metallic material comprising the steps recited herein, particularly the steps as set out in claims 1-14.

The most significant improvements are found on high strength metallic materials.

Preferably, the material is steel. More preferably, the material is advanced high strength steel (AHSS), most preferably ultra-high strength steel (UHSS).

Preferably, the material is a cold-rolled martensitic steel. Preferably, the material is a dual phase steel.

As used herein, "advanced high strength steel" has a yield strength of ≥550 MPa, while ultra-high strength steel (a subset of AHSS) has a yield strength of ≥780 MPa.

Preferably, the material has a high yield to tensile strength ratio (i.e. the ratio of yield strength to tensile strength). Preferably, the material has a yield to tensile strength ratio of from 0.85 to 1.0, more preferably from 0.87 to 1.0, even more preferably from 0.9 to 1.0.

As used herein, the tensile and yield strengths are measured using ISO 6892-1 or EN 10002-1, preferably ISO 6892-1.

A further aspect of the present disclosure is a nested double die for air bending a plate of metal, said double die comprising a first die having a first die width $W_1$ and a second die having a second die width $W_2$, wherein the second die width is less than the first die width, and wherein the second die is positioned below and within the first die and aligned such that the planes formed by the die supports of the first and second dies are parallel, and the centre lines of the first and second dies are parallel and both reside in a plane perpendicular to the planes formed by the top edges of the first and second dies.

Figure 18:
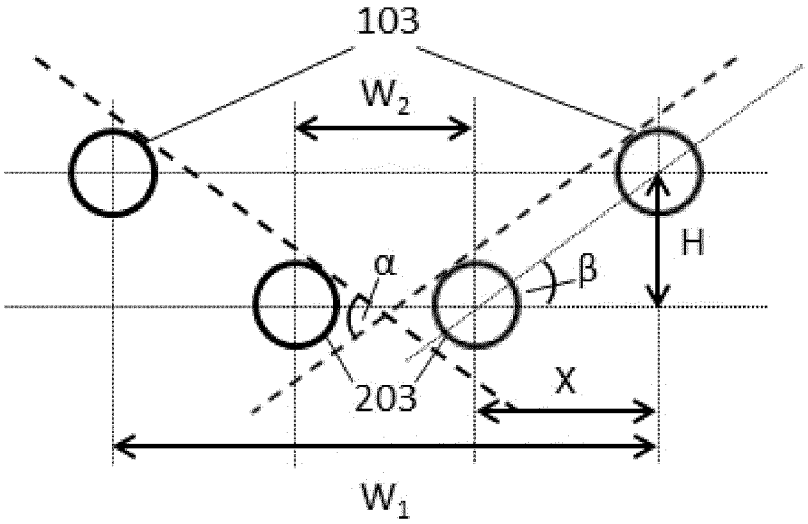
FIG. 18 is a schematic of the nested double die of the disclosure.

Such a nested double die is shown schematically in FIG. 18. In order to ensure the nested double die provides a first and second bending step in accordance with the preferred embodiments of the present disclosure, the height difference H between the first die 103 and the second die 203 is set to ensure that the nesting angle β shown in FIG. 18 is approximately half the preferred bending angles α mentioned above. Likewise, the second die width $W_2$ is adjusted to be about ¼ to ⅔, typically ⅓ to ⅔ of the first die width $W_1$. As H and X are related to tan(β), and X corresponds to $(W_1-W_2)/2$, these requirements mean that the nested double die of the disclosure preferably complies with the following equations:

$$4W_2 \geq W_1 \geq \frac{3}{2}W_2; \text{ and}$$

$$0.15 \leq \frac{2H}{(W_1 - W_2)} \leq 2.2$$

Preferably:

$$4W_2 \geq W_1 \geq \frac{3}{2}W_2; \text{ and}$$

$$0.2 \leq \frac{2H}{(W_1 - W_2)} \leq 1.8$$

Preferably:

$$3W_2 \geq W_1 \geq \frac{3}{2}W_2; \text{ and}$$

$$0.5 \leq \frac{2H}{(W_1 - W_2)} \leq 1.8$$

Preferably:

$$5/2W_2 \geq W_1 \geq 5/3W_2$$

Preferably:

$$0.6 \leq \frac{2H}{(W_1 - W_2)} \leq 1.2$$

Preferably:

$$0.6 \leq \frac{2H}{(W_1 - W_2)} \leq 1$$

More preferably:

$$0.7 \leq \frac{2H}{(W_1 - W_2)} \leq 1$$

As noted above, the advantages of the new method may be achieved at relatively low initial bending angles. Therefore, possible ranges of die geometries satisfy the following equations:

$$0.15 \leq \frac{2H}{(W_1 - W_2)} \leq 1$$

Preferably:

$$0.2 \leq \frac{2H}{(W_1 - W_2)} \leq 1$$

Preferably:

$$0.3 \leq \frac{2H}{(W_1 - W_2)} \leq 1$$

Preferably:

$$0.4 \leq \frac{2H}{(W_1 - W_2)} \leq 1$$

Preferably:

$$0.5 \leq \frac{2H}{(W_1 - W_2)} \leq 1$$

These geometries are suitably used with the ratios of $W_1$ and $W_2$ specified above.

As set out above, the methodology typically ensures that the strain after the first bend should be at a certain level, preferably from 2% to 6%. As the strain is proportional to the thickness of the material being bent, the methodology may alternatively be expressed in terms of this thickness using the following equations:

$$\tan\beta = \tan\frac{\alpha}{2} = \frac{2H}{(W_1 - W_2)}$$

Deriving H;

$$H = \frac{(W_1 - W_2)}{2} \cdot \tan\frac{\alpha}{2}$$

$W_1$ and $W_2$, can be expressed as;

$$W_1 = \frac{1}{\frac{W_2}{W_1}} \cdot W_2$$

$$W_2 = \frac{W_2}{t} \cdot t$$

And, as has been derived before;

$$\alpha = 1 \Big/ \frac{W_2}{W_1} \cdot \varepsilon \cdot \frac{W_2}{t} = \varepsilon \cdot \frac{W_2}{t} \cdot \frac{W_1}{W_2}$$

Hence;

$$\frac{H}{t} = \frac{W_2}{t} \cdot \frac{\left(\frac{W_1}{W_2} - 1\right)}{2} \cdot \tan\left(\frac{1}{2} \cdot \varepsilon \cdot \frac{W_2}{t} \cdot \frac{W_1}{W_2}\right)$$

By the ratio, H/t, it makes it simpler to perform the height adjustments having the material thickness as a reference. The value of the ratio H/t is the multiple of the material thickness that gives the height, H.

FIGS. 21B and 22B show the plots of H/t vs $W_2$/t at constant strain (FIGS. 21B—2% and 6%; FIG. 22B—2.5% and 4.5%) for various ratios of $W_2/W_1$.

As has been noted before, the most common die widths for high strength materials are in the range of 101 to 13*t. For the preferred strains of 2% to 6% and preferred width ratios $W_2/W_1$ of ⅖ to ½, the ranges of H/t will become:

$$0.6 \leq \frac{H}{t} \leq 14$$

For the ratio of $W_2/W_1$ of ⅖ to ½ and strains of 2.5% to 4.5%, the ranges of H/t become:

$$0.8 \leq \frac{H}{t} \leq 9$$

These equations can be adapted to determine the approximate displacement of the bending punch which is needed to achieve a desired strain for a given material and die width. This parameter is useful when practicing the method using an adjustable die. For instance, rearranging the equation for a known from the art (and set out above), the displacement of the bending punch may be expressed as:

$$S = \frac{W_1}{2} \cdot \mathrm{Tan}\left(\frac{\alpha}{2}\right) + (R_d + R_k + t) \cdot \left(1 - \frac{1}{\cos\left(\frac{\alpha}{2}\right)}\right)$$

where $W_1$ is the initial die-width $R_d$, is the entering die-radius for the movable die $R_k$, the knife radius α, is the estimated angle at the end of the first bending step.

The bend angle may be expressed in relation to the strain as:

$$\alpha = \varepsilon \cdot \frac{W_2}{t} \cdot \frac{W_1}{W_2} = \varepsilon \cdot \frac{W_1}{t}$$

where, $W_2$, is the second die width that the movable die will be adjusted to, after the first bend.

$$\frac{W_1}{W_2},$$

the ration between first and the second die width (or alternatively the ratio between outer and inner die width for a corresponding nested double die)

ε, the level of pre-straining at the first bending step

For the adjustable die, the distance, X, that both die supports need to be adjusted (see FIG. 18) may be expressed as:

$$X = \frac{W_1 - W_2}{2} \text{ Or; } \frac{X}{t} = \frac{W_1 - W_2}{2t} = \frac{W_2}{t} \cdot \frac{\left(\frac{W_1}{W_2} - 1\right)}{2}$$

As has been demonstrated for the nested double die:

$$\frac{H}{t} = \frac{W_2}{t} \cdot \frac{\left(\frac{W_1}{W_2} - 1\right)}{2} \cdot \tan\frac{\alpha}{2}$$

Accordingly, $$\frac{X}{t},$$

corresponds to;

$$\frac{X}{t} = \frac{H}{t} \Big/ \tan\frac{\alpha}{2}$$

Figure 20:
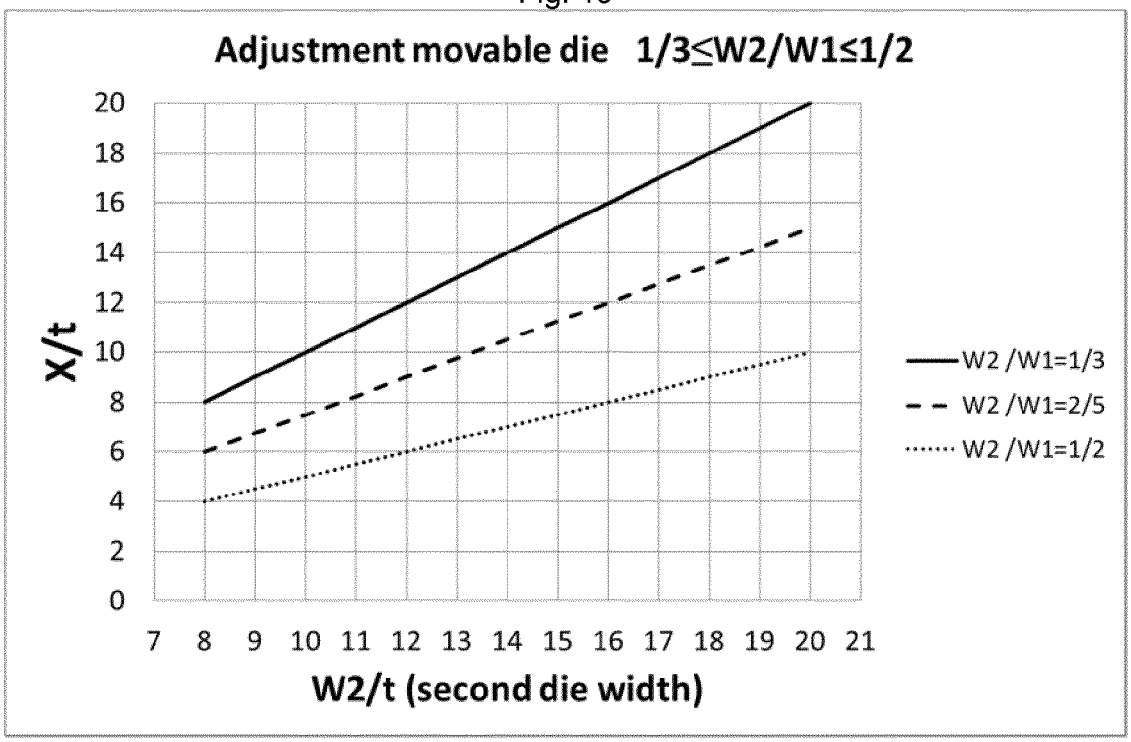
FIG. 20 is a plot of X/t versus $W_2$/t at different ratios of $W_2/W_1$.

(see FIG. 18);

FIG. 20 shows how the value X/t varies in relation to $W_2/t$ for different ratios of $W_2/W_1$.

Preferably, the rim of the first die comprises rollers. Using rollers in the first die reduces the friction where the plate contacts the die, reducing the likelihood of the bending forces being focussed at the bend and deformities arising.

Still a further aspect of the present disclosure is an adjustable die for air bending plates of material (e.g. metal) comprising an adjustable die portion mounted on height adjustment means, the adjustable die portion comprising movable edges that allow the die width to be adjusted, said height adjustment means allowing the position of the adjustable die portion to reversibly move in a direction perpendicular to the plane formed by the die opening, wherein preferably said reversible movement capable of being effected in response to an external force.

Preferably, the reversible movement of the height adjustment means is capable of allowing the die width of the adjustable die portion to be adjusted without varying the angle formed by the die edges and a nominal point lying below the plane of the die opening. In this way, the height adjustment means allows the die width to be adjusted while a bending punch is in contact with a metal plate after a first air bending step without the movement of the die edges causing a change in the bending moment between the die edges and punch.

Thus, still a further aspect of the present disclosure is an apparatus for air bending plates of material (e.g. metal) comprising an adjustable die comprising an adjustable die portion mounted on height adjustment means, the adjustable die portion comprising movable edges which are parallel and define a die opening having a die width, said movable edges allowing the die width to be adjusted, a bending punch orientated parallel to the movable edges and arranged to move in a plane equidistant from the movable edges and perpendicular to the plane formed by the die opening of the adjustable die from a position above the die opening to a position below the die opening, said height adjustment means allowing the position of the adjustable die portion to reversibly move in a direction perpendicular to the plane formed by the die opening, characterised in that the reversible movement of the height adjustment means is capable of allowing the die width of the adjustable die to be adjusted while the bending punch resides in a position below the die opening without varying the angle formed by the movable edges and the bending punch.

Typically, the height adjustment means is a spring or piston, preferably a piston.

Still a further aspect of the present disclosure is an apparatus for air bending plates of material (e.g. metal) comprising an adjustable die comprising an adjustable die portion, the adjustable die portion comprising movable edges that allow the die width to be adjusted, a bending punch comprising a contacting portion, a force providing portion and a height adjustment means, said height adjustment means allowing the position of the contacting portion to reversibly move relative to the force providing portion of the bending punch in a direction perpendicular to the plane formed by the die opening.

The apparatus is suitable for air bending and as such the movable edges are parallel and define a die opening having a die width, and the bending punch is oriented parallel to the movable edges and arranged to move in a plane equidistant from the movable edges and perpendicular to the plane formed by the die opening of the adjustable die from a position above the die opening to a position below the die opening.

The height adjustment means compensates for any movement of the plate while the die width is adjusted without any movement or change of the force providing portion of the bending punch being required. In other words, when a plate has been bent by the bending punch, the contacting portion of the punch resides between (or below) the movable edges of the adjustable die. Adjusting the die width while the plate is still in place will push the plate up against the contacting portion (or alternatively cause the plate to drop away from the contacting portion if the die width is increased). The height adjustment means allows the contacting portion to move up or down to compensate for this, so that it remains in contact with the plate without any change in the bending force on the plate while the die width is adjusted and without requiring any change in the force providing portion.

Thus, preferably the height adjustment means allows the die width of the adjustable die portion to be adjusted while the contacting portion of the punch resides in a position below the die opening without varying the angle formed by the movable edges and the contacting portion and without any movement of the force providing portion.

The disclosure therefore preferably provides an apparatus for air bending plates of material (e.g. metal) comprising

- an adjustable die comprising an adjustable die portion, the adjustable die portion comprising movable edges which are parallel and define a die opening having a die width, said movable edges allowing the die width to be adjusted,
- a bending punch oriented parallel to the movable edges and arranged to move in a plane equidistant from the movable edges and perpendicular to the plane formed by the die opening of the adjustable die from a position above the die opening to a position below the die opening,
- said bending punch comprising a contacting portion, a force providing portion and a height adjustment means,
- said height adjustment means allowing the position of the contacting portion to reversibly move relative to the force providing portion of the bending punch in a direction perpendicular to the plane formed by the die opening, characterised in that

- the height adjustment means allows the die width of the adjustable die portion to be adjusted while the contacting portion of the punch resides in a position below the die opening without varying the angle formed by the movable edges and the contacting portion and without any movement of the force providing portion.

In these embodiments, the adjustable die portion has a maximum die width of $W_1$, and the movable edges are preferably capable of adjusting the die width to provide a second die width of $W_2$, wherein:

$$W_1 \geq 3/2 W_2$$

More preferably:

$$W_1 \geq 2 \cdot W_2$$

More preferably:

$$W_1 \geq 3 \cdot W_2$$

More preferably:

$$W_1 \geq 4 \cdot W_2$$

Likewise, the height adjustment means is preferably capable of moving at least 4% of $W_1$, where $W_1$ is the die width of the first die, preferably at least 5% of $W_1$, more preferably at least 7.5% of $W_1$, more preferably the height adjustment means is capable of moving from 4% of $W_1$ to 55% of $W_1$, more preferably from 4% to 40% of $W_1$, more preferably from 5% to 35% of $W_1$, alternatively from 10% of $W_1$ to 55% of $W_1$, more preferably from 15% of $W_1$ to 40% of $W_1$.

The following non-limiting examples implement the methodology of the disclosure.

Example 1

Several 6 mm thick plates of hot rolled steel with a yield strength of 960 MPa were bent to 90° using a conventional air bending die and using a nested double die in accordance with the present disclosure. The double die comprised an outer die with a width of 180 mm and an inner die with a width of 80 mm (i.e. 13×t). The inner die was positioned 35 mm below the outer die (i.e. the distance between the top of the entering die radii). Using this arrangement, the first bending angle is approximately 70°. The approximate pre-straining percent was around 4.1%. The control bending used a single bending die with a die width of 80 mm.

The results obtained are summarised in the following table:

| Sample | Bending Direction | R/t Conventional | R/t Disclosure |
|---|---|---|---|
| 1 | Rolling | 3.0 | 2.0 |
| 2 | Rolling | 3.0 | 1.7 |
| 3 | Rolling | 3.2 | 1.7 |
| 4 | Traverse | 2.5 | 1.8 |

These data show that the bendability achieved using the methodology of the present disclosure is significantly improved over using a conventional single bending step.

Example 2

Two types of high strength cold rolled steel labelled 1000 DP HT and 1200M (having yield strengths of about 1000 and 1200 MPa respectively, were bent to 90° using conventional air bending and using a two-step method according to the present disclosure.

The same setup for double-die was used for the both materials tested, even though different thicknesses, 1.0 and 1.4 mm, respectively. The setup for the two tests is shown in the tables below.

| 1000 DP HT, 1.4 mm | | | | | |
|---|---|---|---|---|---|
| Double.die | | | | | Conventional die |
| Die-width W [mm] | | Vertical distance | Approx. Angle α | Approx. | W [mm] |
| Outer-die | Inner-die | outer- & inner-die [mm] | at contact [degrees] | pre-straining [%] | Die |
| 49 | 20 | 11 | 75 | 3.7 | 20 |

| 1200 M, 1.0 mm | | | | | |
|---|---|---|---|---|---|
| Double.die | | | | | Conventional die |
| Die-width W [mm] | | Vertical distance | Approx. Angle α | Approx. | W [mm] |
| Outer-die | Inner-die | outer- & inner-die [mm] | at contact [degrees] | pre-straining [%] | Die |
| 49 | 20 | 11 | 75 | 2.6 | 20 |

The results are shown in the table below:

| Sample | R/t Conventional | R/t Disclosure |
|---|---|---|
| 1000 DP HT | 4.9 | 2.5 |
| 1200M | 5.0 | 3.0 |

As can be seen, the bendability is significantly improved using the methodology of the present disclosure.

Example 3

A nested double die with a length of 3 meter was tested confirming the same improvement in a full-scale test as for shorter samples presented before. The material used in the test was a 6 mm hot rolled steel, with a yield-strength 960 MPa and ultimate-strength of approximately 1050 MPa. In all tests the material was bent 90 degrees. Initially short samples, with a length of 400 mm, were bent in a conventional die to obtain the minimum bending-radius for the material applied. In the next step, short samples were bent in the full-scaled nested double die to optimize the height-positioning of the inner-die. Finally a full-length plate was bent. In table below, the setups for the tests are shown.

| Double-die | | | | | Conventional die |
|---|---|---|---|---|---|
| Die-width W [mm] | | Vertical distance | Approx. Angle α | Approx. | W [mm] |
| Outer-die | Inner-die | outer- & inner-die [mm] | at contact [degrees] | pre-straining [%] | Die |
| 180 | 80 | 25 | 53 | 3.1 | 80 |

The results obtained are summarized in the following table:

| Sample | Length of bend [mm] | Bending Direction | $R_i$/t Conventional | $R_i$/t Invention | Knife radius [mm] |
|---|---|---|---|---|---|
| 1 | 400 | Rolling | 3.1 | | 23 |
| 2 | 400 | Rolling | | 1.8 | 15 |
| 3 | 2900 | Rolling | | 1.8 | 15 |

The result confirms that the improvement in bendability by applying double-die bending still working for bending long beams.

Example 4

A hot rolled 900 MPa material, with a thickness 10 mm, was tested in double-die bending. The goal for the test was to achieve a bending-radius that is acceptable, e.g. making upgrading of heavy vehicle frame-beams. The bending radius required to make such a upgrading close to 2 times the thickness. For conventional bending, it is a huge step regarding bendability performance between steel on 700- to 900 level in yield. Table below shows the setup for the test.

| Double-die | | | | | Conventional die |
|---|---|---|---|---|---|
| Die-width W [mm] | | Vertical distance | Approx. Angle α | Approx. | W [mm] |
| Outer-die | Inner-die | outer- & inner-die [mm] | at contact [degrees] | pre-straining [%] | Die |
| 180 | 80 | 14 | 31 | 3.0 | 150 |

The material-batch used had a quite poor bendability performance compared what it should be. The data sheet says 4.5×t as the minimum bending radius for conventional bending.

For this particular batch it was confirmed to be a bit more, i.e. 5×t preventing "flattening". The "flattening" tendency is when the outer-fiber of the bend tends to localize and not get a homogeneous shape of curvature. However, even for a material with poor performance in bending, the double-bending technique improves the bendability tremendously. In table below the result is shown.

| Sample | Length of bend [mm] | Bending Direction | $R_i$/t Conventional | $R_i$/t Invention | Knife radius [mm] |
|---|---|---|---|---|---|
| 1 | 150 | Rolling | 5.0 | | 50 |
| 2 | 150 | Rolling | | 2.2 | 22 |

This beam produced had a flange-height of 100 mm only, still possible by double-die bending although the outer-tool requires additional material able to support in the initial phase of the process.

Example 5

Pre-bending with large punch using the same die-width.

The hot-rolled 960 material with thickness 6 mm was first pre-bent, to approximately α=60 degrees, using a punch with radius of 35 mm. Then the punch was changed to more narrow size, i.e. radius 18 mm, and finally bent to 90-degrees of bend.

In the next test, the same bend was made on an identical material in the conventional way using one bending stroke with a punch radius of 18 mm.

The same die-width was used in both experiments, W=85 mm.

Figure 19:
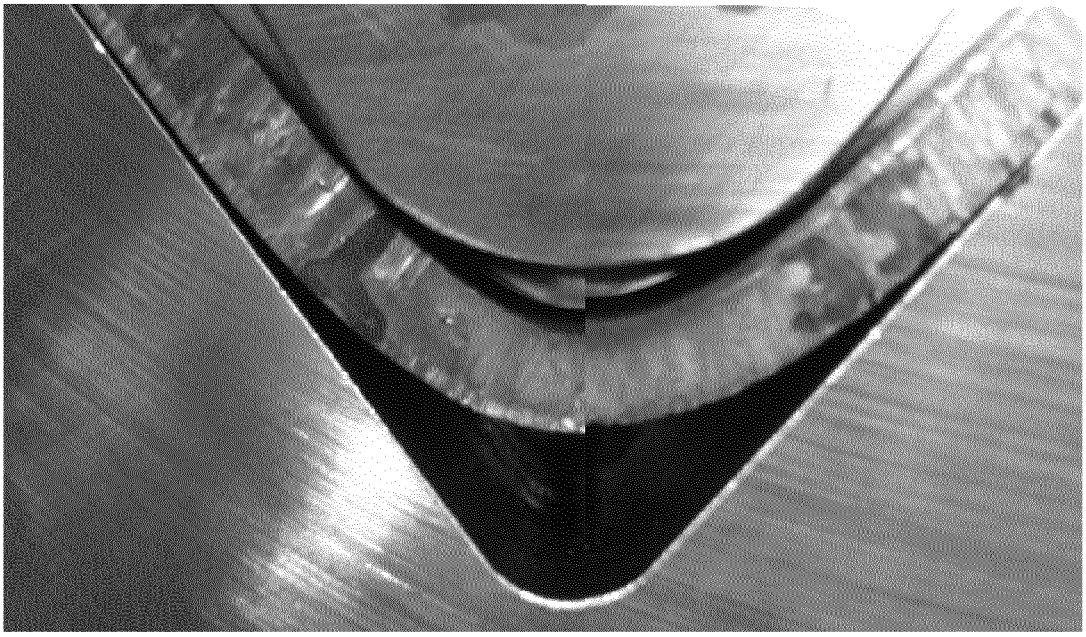
FIG. 19 is a superposition of the bent plates following the two bending tests in Example 5, with the bend according to the disclosure being shown on the right.

In FIG. 19, both bends are presented in same picture to show the differences in shape. The image is therefore a composite made up from a photograph of the plate bent according to the disclosure (right hand side) and the plate bent according to prior art methodologies (left hand side). The images have been aligned to ensure the punch and die approximately line up. The dividing line between the left and right hand side is however clearly visible from the discontinuity in the plate. The figure shows the improved curvature achieved by using the methodology of the disclosure involving a pre-bending step with a larger punch radius.

Figure 23A:
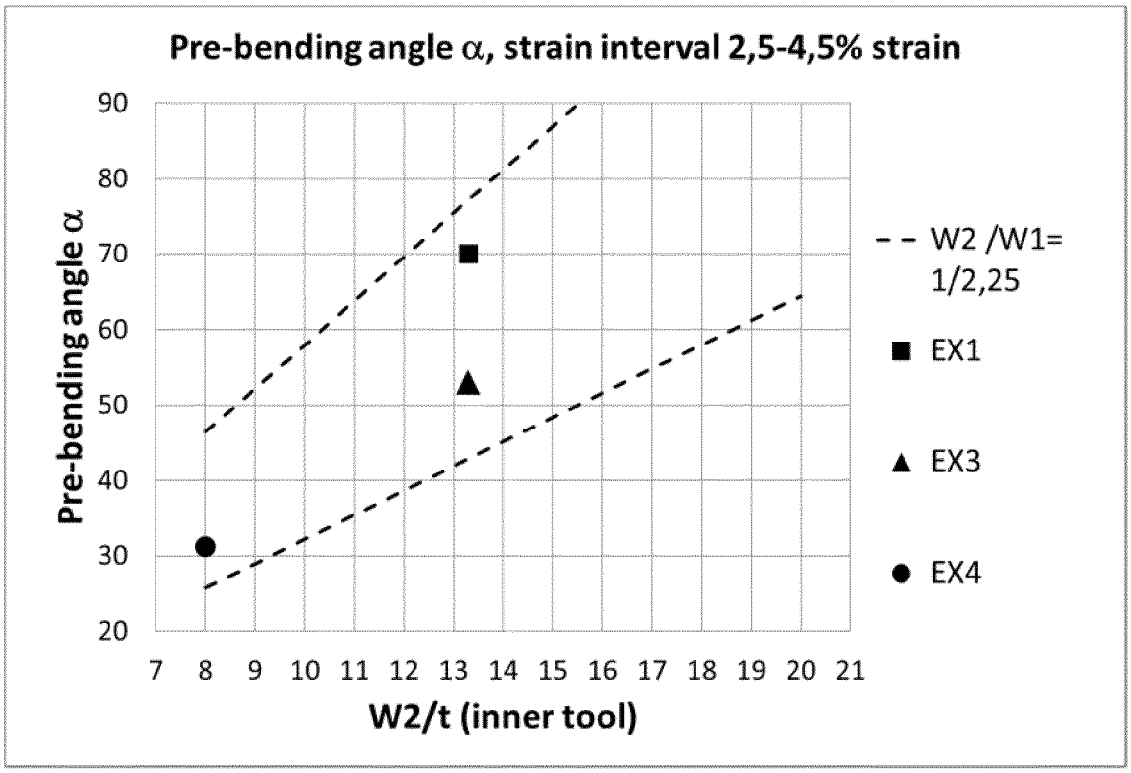
FIG. 23A is a plot of pre-bending angle α versus $W_2$/t for Examples 1, 3 and 4.
Figure 23B:
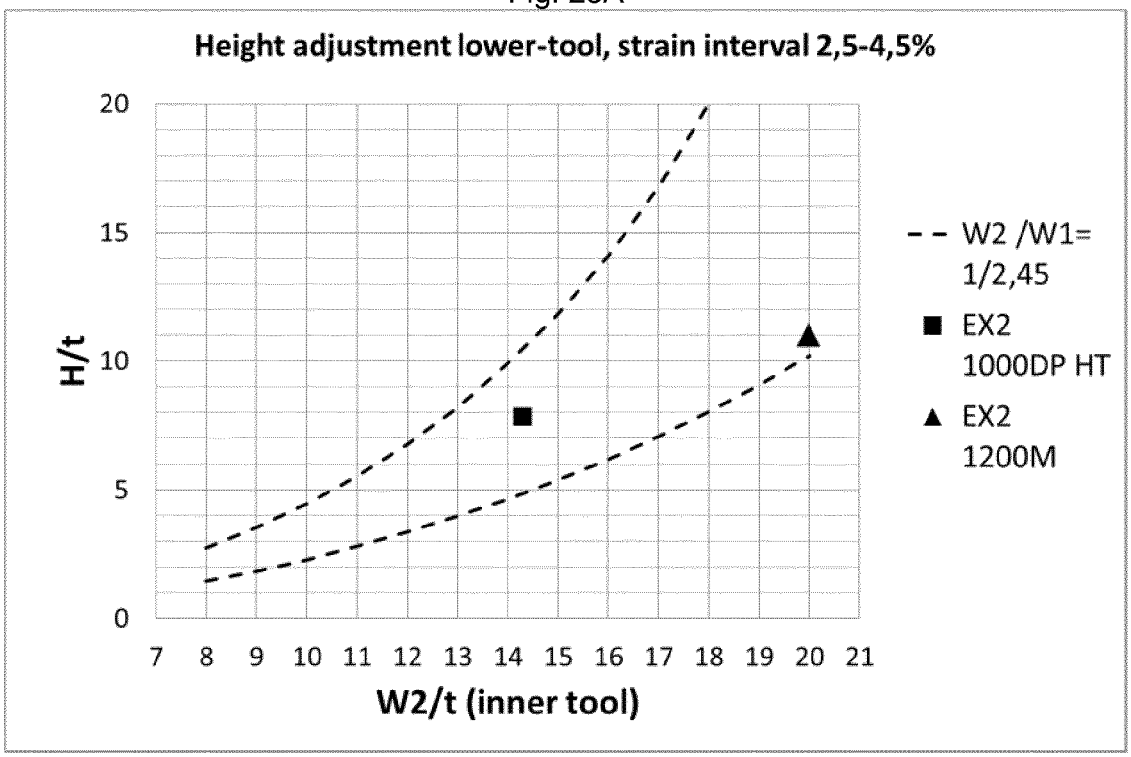
FIG. 23B is a plot of pre-bending angle α versus $W_2$/t for Example 2.
Figure 24A:
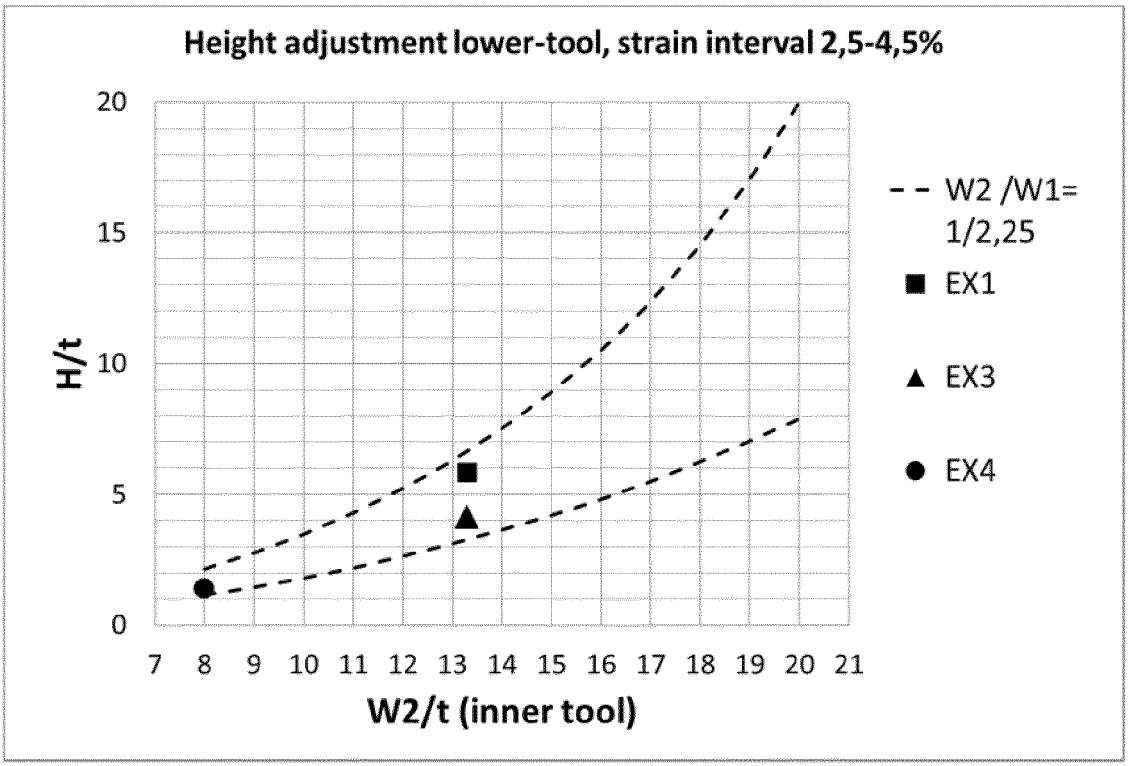
FIG. 24A is a plot of H/t versus $W_2$/t for Examples 1, 3 and 4.
Figure 24B:
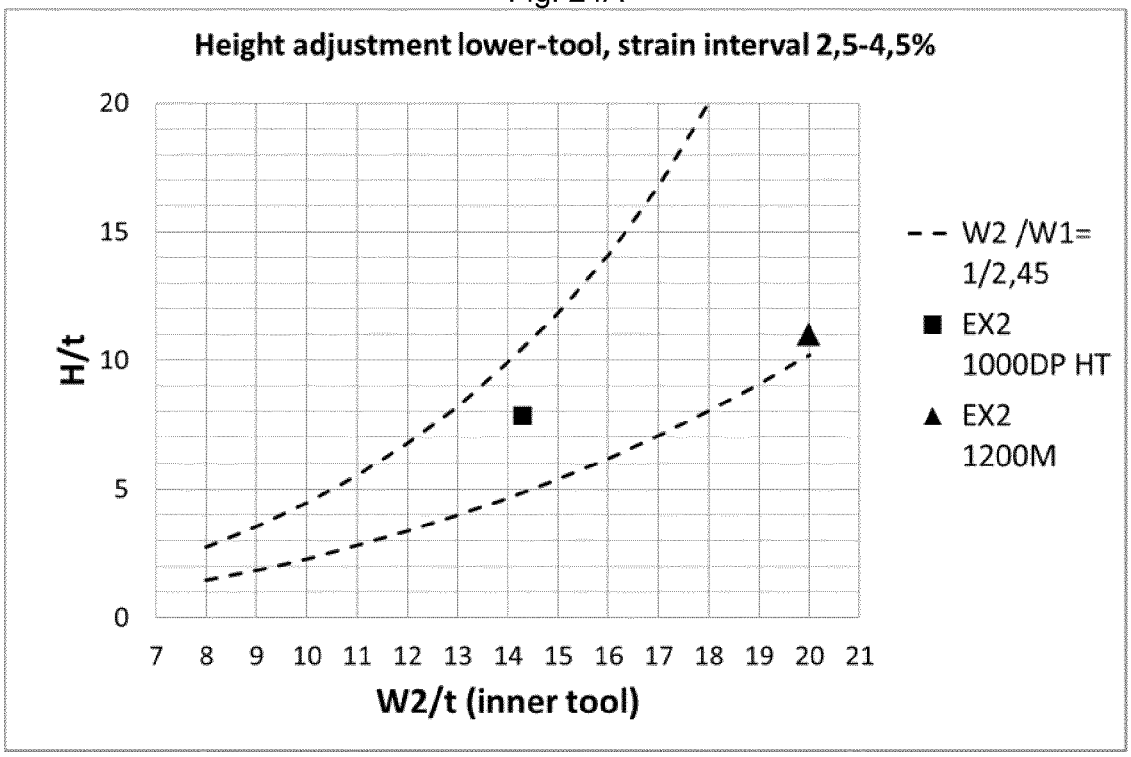
FIG. 24B is a plot of H/t versus $W_2$/t for Example 2.

FIGS. 23A and 23B show the pre-bending angle α versus $W_2$/t value for each of Examples 1-4, with the strain intervals of 2.5-4.5% being shown as dashed lines. Examples 1, 3 and 4 use a double die with a $W_2/W_1$ ratio of 1/2.25, while the double die in Example 2 has a ratio of 1/2.45. FIGS. 24A and 24B show similar plots but for the H/t versus $W_2$/t values. As can be seen, all examples lie within the desired strain ranges typically needed to optimise the method.

Further modifications of the disclosure within the scope of the claims would be apparent to a skilled person. For example, a method according to the disclosure need not necessarily be carried out using a nested double die or an adjustable die, but may be carried out using any die or dies as long as it can be ensured that the first and second bending forces are applied at the same point of the plate of material and in the same direction. Furthermore, the method need not necessarily be limited to form a bend in a flat plate of material having a uniform thickness and cross-section. A plate of material may comprise at least one non-planar portion and/or have a non-uniform thickness and/or non-uniform cross-section.

The invention claimed is:

1. A method of forming a bend in a plate of metallic material, said method comprising:

air bending the plate of metallic material in a first air bending step by applying a first bending force using a bending punch and a first die having a first die width; then air bending the plate of metallic material in a second air bending step by applying a second bending force using the bending punch and a second die having a second die width, wherein the first and second bending force are applied at the same point of the plate and in the same direction;

characterised in that the method is performed where:

the second die width is less than the first die width, wherein a nested double die is used in which the second die resides below and within the first die, the first and second die being aligned such that the planes formed by the die supports of the first and second dies are parallel, and such that the midpoint of the first die and second die lie in the plane traversed by the bending punch during the first and second bending steps, wherein at the end of the first bending step, the bent metal plate is simultaneously in contact with both the first die and the second die, wherein the method is performed such that the plate of metallic material does not touch a bottom of the second die.

2. The method of claim 1, wherein the first die width Wi and the second die width $W_2$ satisfy the following relationship:

$$4W_2 \geq W_1 \geq \frac{3}{2}W_2.$$

3. The method of claim 2, wherein $W_1$ is from 18 t to 30 t, wherein t is the thickness of the plate being bent.

4. The method of claim 1, the height difference H between the first and second dies satisfying the following relationship:

$$0.15 \leq \frac{2H}{(W_1 - W_2)} \leq 2.2$$

wherein $W_1$ is the first die width, and $W_2$ is the second die width.

5. The method of claim 1, wherein $$1.3 \leq \frac{H}{t} \leq 16$$

wherein H is the height difference between the first and second dies, and t is the thickness of the metallic material being bent.

6. The method of claim 1, wherein the strain of the outer fibres of the bend at the end of the first bending step is from 2% to 9%.

7. The method of claim 1, wherein a bending angle after the first bending step is from 15° to 120°.

8. The method of claim 1, wherein the metallic material has a yield to tensile strength ratio of 0.85 to 1.0, wherein the metallic material is steel.

9. A method of forming a bend in a plate of metallic material, said method comprising:

air bending the plate of metallic material in a first air bending step by applying a first bending force using a bending punch and a first die having a first die width; then air bending the plate of metallic material in a second air bending step by applying a second bending force using the bending punch and a second die having a second die width, wherein the second die does not have a bottom, wherein the first and second bending force are applied at the same point of the plate and in the same direction;

characterised in that the method is performed where:

the second die width is less than the first die width, wherein a nested double die is used in which the second die resides below and within the first die, the first and second die being aligned such that the planes formed by the die supports of the first and second dies are parallel, and such that the midpoint of the first die and second die lie in the plane traversed by the bending punch during the first and second bending steps, wherein at the end of the first bending step, the bent metal plate is simultaneously in contact with both the first die and the second die.

10. A method of forming a bend in a plate of metallic material, said method comprising:

air bending the plate of metallic material in a first air bending step by applying a first bending force using a first bending punch and a first die having a first die width; then air bending the plate of metallic material in a second air bending step by applying a second bending force using a second bending punch and a second die having a second die width, wherein the first and second bending force are applied at the same point of the plate and in the same direction;

characterised in that the method is performed where:

the second die width is less than the first die width and a radius of the second bending punch is less than a radius of the first bending punch, wherein a nested double die is used in which the second die resides below and within the first die, the first and second die being aligned such that the planes formed by the die supports of the first and second dies are parallel, and such that the midpoint of the first die and second die lie in the plane traversed by the bending punch during the first and second bending steps, wherein at the end of the first bending step, the bent metal plate is simultaneously in contact with both the first die and the second die.

11. The method of claim 1, wherein each of the first air bending step and the second air bending step comprises a respective three point free bending step.

12. The method of claim 1, wherein the plate of metallic material has a thickness, wherein the thickness of the plate of metallic material is less than a spacing between the bending punch and the second die at every position of the bending punch.

* * * * *